United States Patent [19]

Uchiyama et al.

[11] 4,228,712

[45] Oct. 21, 1980

[54] KEY CODE DATA GENERATOR

[75] Inventors: Yasuji Uchiyama; Akira Nakada; Takatoshi Okumura; Eiichiro Aoki; Eiichi Yamaga; Akiyoshi Oya, all of Hamamatsu, Japan

[73] Assignee: Nippon Gakki Seizo Kabushiki Kaisha, Hamamatsu, Japan

[21] Appl. No.: 940,381

[22] Filed: Sep. 7, 1978

[30] Foreign Application Priority Data

Sep. 12, 1977 [JP] Japan ..... 52-109750

[51] Int. Cl.[3] ..... G10H 1/00

[52] U.S. Cl. ..... 84/1.01; 84/1.03

[58] Field of Search ..... 84/1.01, 1.03, DIG. 22

[56] References Cited

U.S. PATENT DOCUMENTS

| | | | |
|---|---|---|---|
| 3,916,750 | 11/1975 | Uetrecht | 84/1.01 |
| 4,022,098 | 5/1977 | Deutsch et al. | 84/1.03 |
| 4,100,831 | 7/1978 | Deutsch | 84/1.01 |
| 4,114,495 | 9/1978 | Tumisawa | 84/1.01 |
| 4,120,225 | 10/1978 | Dietrich et al. | 84/1.03 |
| 4,134,320 | 1/1979 | Oya | 84/1.01 |
| 4,141,268 | 2/1979 | Kugisawa | 84/1.01 |
| 4,142,433 | 3/1979 | Gross | 84/DIG. 22 |
| 4,144,788 | 3/1979 | Bioni et al. | 84/1.01 |
| 4,148,241 | 4/1979 | Morez et al. | 84/DIG. 22 |

*Primary Examiner*—J. V. Truhe
*Assistant Examiner*—Forester W. Isen
*Attorney, Agent, or Firm*—Spensley, Horn, Jubas & Lubitz

[57] ABSTRACT

Key switches are connected in a matrix fashion between row lines making block lines for octaves and column lines making note lines for notes. The note lines are connected to a note detection circuit which converts the note line outputs of the actuated switches into key codes in a time shared fashion and to a chord detection circuit which includes a chord type detecting logic and a shift register connected thereto and storing the note line outputs in its respective stages. During a chord detecting period, the note detection circuit is loaded with signals "1" as if all the key switches were actuated and delivers key codes of all notes one after another, whereas the shift register is circulatingly shifted synchronously with the note code change. When the logic detects an establishment of a chord, the note code of that moment is extracted to be a code identifying the root note of the chord. The root note code is then processed for automatic bass and chord performance.

8 Claims, 14 Drawing Figures

KEY CODE DATA GENERATOR

BACKGROUND OF THE INVENTION

This invention relates to a key code data generator capable of detecting switches in operation among a number of key switches and function switches and generating key code data for an automatic bass chord performance on the basis of signals from the detected switches.

The specification of U.S. Pat. No. 4,148,017 to the same assignee discloses a key code data generator which detects an on (or off) state of a key switch among a large number of key switches provided on a keyboard of an electronic musical instrument and generates key code data representative of a depressed key in accordance with a result of detection. The specification of U.S. patent application No. 825,443 to the same assignee also discloses a key code data generator which generates key code data to be utilized for an automatic bass performance and an automatic chord performance from key code data representing a depressed key.

Simplification of circuitry and reduction of the number of pins which constitute input and output terminals are major problems to be solved in designing a key code data generator in an integrated circuit configuration.

In the prior art key code data generator disclosed in the U.S. Pat. No. 4,148,017 the key switches are divided into blocks and also grouped by each note name in the respective blocks, and are arranged in a matrix fashion, respective blocks are scanned by a block detection circuit and respective note name groups are scanned by a note detection circuit for detection of a key switch in operation. This arrangement has considerably reduced the number of required input and output lines. The electronic musical instrument employing this prior art key code data generator, however, still requires many signal lines for transmitting signals from a number of function switches if the electronic musical instrument has various performance functions such as the automatic bass/chord performance and the automatic arpeggio performance. Accordingly, this prior art generator is not sufficient for the instrument in respect of the number of signal lines.

The electronic musical instrument proposed in U.S. patent application No. 825,443 detects an on or off state of key switches and function switches, generates key codes representing key switches which are on and generates key code data for the automatic bass chord performance by utilizing signals obtained by decoding these key codes. The construction of this circuit is fairly complicated and it will be difficult to design this circuit in an integrated circuit configuration using only one chip.

SUMMARY OF THE INVENTION

It is, therefore, a main object of the present invention to utilize the note detection circuit for the regular note performance and also for detection of the chord being played and delivery of the note code which designates the root note of the chord to be performed.

It is another object of the invention to reduce the number of input and output lines of function switches by detecting an on (or off) state of key switches and function switches by one and the same scanning operation.

It is still another object of the invention to provide a simplified circuit by utilizing signals representing key switches which are on detected upon scanning of the key switches for forming key code data for the automatic bass chord performance.

In the key code data generator according to the present invention, key switches are divided into blocks (e.g. blocks representing octaves) and key switches in the respective blocks are grouped by each note name. Function switches are divided into one or more blocks and function switches in each of the blocks are grouped in said each note name. Thus the switches are arranged in a matrix fashion.

Blocks including a key switch or a function switch which is in an on state are detected by a block detection circuit at a certain timing. Then, one of the detected blocks is extracted at a next timing and a signal representing the key switch or function switch which is on in the extracted block is produced.

A next one of the detected blocks is extracted and a signal representing the key switch or function switch which is on in this block is produced. In this manner, key switches and function switches which are on are successively detected in one and the same scanning operation.

In the key code data generator according to the invention, a signal is delivered from a control circuit provided in the block detection circuit to a note detection circuit at a predetermined timing relating to extraction of the detected blocks (e.g. at a time when extraction of all of the detected blocks has been completed) and, in response to this signal from the note detection circuit, the note detection circuit successively delivers out signals representing the detected notes. Key code data for the automatic bass performance and key code data for the automatic chord performance are produced on the basis of the signals delivered from the note detection circuit. By this arrangement, the output of the note detection circuit is directly used for detecting a root note for the automatic bass performance etc. whereby a circuit construction is considerably simplified.

These and other features of the present invention will become apparent from the description made hereinbelow in conjunction with the accompanying drawings.

BRIEF DESCRIPTION OF THE DRAWINGS

In the accompanying drawings:

FIGS. 4 through 6 and FIGS. 8 through 12 are circuit diagrams showing in detail an embodiment of the key code data generator according to the invention in which FIG. 4 shows a block detection circuit, FIG. 5 a note detection circuit, FIG. 6 a state control circuit, FIG. 8 control signal forming circuit, FIG. 9 a chord memory and a function data transmission circuit, FIG. 11 a key code register and key code processing circuit and FIG. 12 a generation circuit respectively;

FIG. 12 is a time chart for explaining the operations of the block detection circuit and the note detection circuit;

DESCRIPTION OF A PREFERRED EMBODIMENT

1. General description of the overall construction

Figure 1:
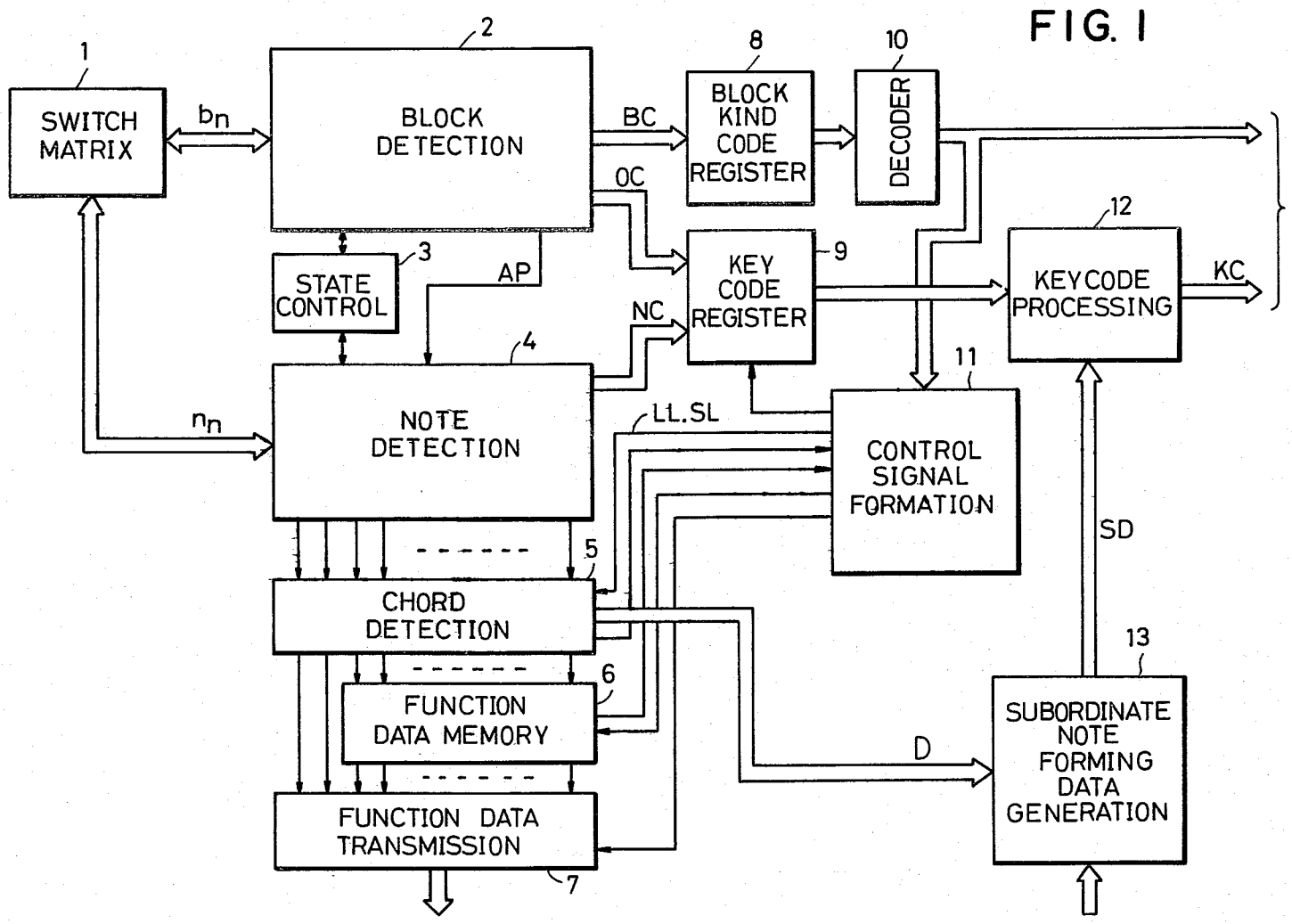
FIG. 1 is a block diagram schematically showing the key code data generator made according to the present invention.

FIG. 1 schematically shows a preferred embodiment of the key code data generator according to the invention. Key switches and function switches 1 are divided into a plurality of blocks whereas the key switches in the respective blocks are grouped note by note and the function switches in the respective blocks are grouped in accordance with some selected notes. The key switches and the function switches belonging to the same block are commonly connected and those belonging to the same note are also commonly connected. The common connection lines for the respective blocks are designated as block lines bn and the common connection lines for the respective notes as note lines nn. Alternatively stated, the key switches and the function switches are disposed in a matrix circuit consisting of the block lines bn arranged as rows and the note lines nn arranged as columns so that a key switch or function switch which is on can be identified by signals delivered on specific ones of the block lines bn and the note lines nn.

A block detection circuit 2 detects, from the signal delivered on the block line bn, a block to which the key switch or function switch which is on belongs. The block detection circuit has storage positions corresponding to the respective blocks, a storage position for an automatic bass/chord processing and a storage position for an automatic arpeggio processing. A note detection circuit 4 detects, from the signal delivered on the note line nn, the note of the key switch or function switch which is on. The note detection circuit 4 has storage positions corresponding to the respective notes (i.e. notenames). The operations of the block detection circuit 2 and the note detection circuit 4 are controlled by successively carrying out four detection operation states, $S_0$, $S_1$, $S_2$, and $S_3$. The first operation state $S_0$ is a stand-by state. In the second operation state $S_1$, a signal is transmitted from the note detection circuit 4 to the block detection circuit 2 through the key switches and function switches which are on to detect all blocks to which the switches which are on belong at once and cause these blocks to be stored in the respective corresponding storage positions. In this operation state, a signal is also stored in the storage positions for the automatic bass/chord processing and the automatic arpeggio processing.

As the operation state proceeds to the state $S_2$, one of the signals stored in the storage positions of the block detection circuit 2 is extracted and delivered out. The extraction of this single signal is conducted in a certain order of precedence. In this embodiment, priority is given in the order of a block including a function switch, a block including a key switch of pedal keyboard, a block including a key switch of a lower keyboard, a block including a key switch of an upper keyboard, the automatic bass/chord processing and lastly the automatic arpeggio processing. No signal is extracted from any of these storage positions while a signal remains stored in a storage position which is of a higher priority order. When a signal is outputted from the storage position of the highest priority in the block detection circuit 2, a signal is simultaneously transmitted from the block detection circuit 2 to the note detection circuit 4 through the block line corresponding to the particular storage position and the key switches or the function switch which is on in that block, thereby causing all notes corresponding to the key switches or the function switch which is on to be detected at once and signals representing these notes to be stored in their respective note storage positions.

As the operation state proceeds to the state $S_3$, the signals stored in the storage positions of the note detection circuit 4 are delivered out one by one in accordance with a certain order of precedence. In this case, priority is given from the lower tone side and as a signal is outputted one by one, the storage position from which the signal has been outputted is cleared. Upon outputting of all of the signals stored in the storage positions of the note detection circuit 4, the operation state returns to the state $S_2$ and a signal is extracted from a storage position corresponding to a block of a next priority in the block detection circuit 2. This signal is transmitted to the note detection circuit 4 through a block line corresponding to the storage position of the signal and notes of key switches or a function switch which is on in the block thereby are detected. Signals representing the detected notes are successively outputted in the next operation state $S_3$. In this manner, the states $S_2$ and $S_3$ are repeated. Upon completion of extraction of the blocks detected in the state $S_1$ and outputting of signals representing blocks and notes corresponding to the key switches and function switches which are on, an automatic bass/chord control signal AP is outputted in the state $S_2$ from the storage position for the automatic bass/chord processing. This signal AP is applied to the respective storage positions of the note detection circuit 4 so that a signal "1" is stored in all of the storage positions. In the next state $S_3$, signals representing respective notes are successively outputted from their respective storage positions in the note detection circuit 4 with priority being given in the lower tone side. These signals are used for detecting a root note in the automatic base performance and the automatic chord performance, as will be described later. As the signal AP has been outputted from the storage position for the automatic bass/chord processing in the block detection circuit 2 and the storage position has been cleared, a signal is then outputted from the storage position for the automatic arpeggio processing. This output from the storage position for the automatic arpeggio processing is not applied to the note detection circuit 4 but serves only to secure a unit operation time (i.e., the period of the clock pulse used for the system) for the automatic arpeggio processing.

When the automatic arpeggio processing time has elapsed, the storage positions of the block detection circuit 2 have all been cleared and the operation state returns to the initial state, i.e., the stand-by state $S_0$. Upon detection of this stand-by state $S_0$, the operation states $S_1$–$S_3$ are carried out again and detection of all the key switches and function switches in operation is repeated.

In the above described manner, detection of blocks including key switches or function switches which are on are carried out in the block detection circuit 2 whereas detection of notes corresponding to the key switches or function switches which are on in the detected blocks is carried out in the note detection circuit 4.

The block detection circuit 2 outputs, in response to each extraction of the block, a block type code BC representing the type of the function block, type of the keyboard and whether the storage position for the automatic bass/chord processing has been extracted or not and also produces an octave code OC representing the octave of the detected key switch. The note detection circuit 4 outputs a note code NC representing the note of the detected key switch. The block kind code BC outputted from the block detection circuit 2 is applied to a block kind code register 8 and held temporarily therein. This code BC held in the register 8 is decoded in a decoder 10 and thereafter is applied to a control signal forming circuit 11. The control signal forming circuit 11 produces a control signal used for controlling a chord detection circuit 5, a function data memory 6, a function data transmission circuit 7 and a key code register 9 to be described later.

The octave code OC outputted from the block detection circuit 2 and the note code NC outputted from the note detection circuit 4 are applied to the key code register 9 and held temporarily therein.

As was previously described, extraction of the block detection circuit 2 is conducted with priority being given first to the block including a function switch. Accordingly, the note detection circuit 4 first outputs, in parallel, signals representing function switches which are on from storage positions of the notes corresponding to the function switches. These signals are applied to the function data memory 6 and the function data transmission circuit 7 through the chord detection memory 5. The function data memory 6 is provided for storing function data used in this circuit i.e., in this chip and data which is not used in this chip is applied to the function data transmission circuit 7. The function data transmission circuit 7 consists, for example, of a shift register and converts input parallel function data to serial data. The converted data outputted from the circuit 7 is applied to a control data memory (not shown). The control data memory consists, for example, of a read-out memory and produces desired control data such as for determining a bass pattern in the automatic bass performance in response to the applied function data. Detailed description of this control data memory will be omitted for this memory is not related to the subject matter of the present invention.

The block detection circuit 2 subsequently extracts the blocks in the order of the block including the key switches of the pedal keyboard, the block including the key switches of the lower keyboard and the block including the key switches of the upper keyboard. In response to the extraction, the octave code OC is produced from the block detection circuit 2 and the note code NC from the note detection circuit 4. These codes are held temporarily in the key code register 9 and thereafter are supplied to a channel processor (not shown) through a key code processing circuit 12. The key code processing circuit 12, however, does not operate at this time and the key code KC stored temporarily in the key code register 9 is transmitted to the channel processor without being processed by the processing circuit 12. To the channel processor is also applied a signal from the decoder 10. The channel processor assigns, in response to these signals, key code data designating a tone to be produced to one of channels equal in number to a maximum number of tones to be sounded simultaneously (e.g. twelve) for necessary processing. As the channel processor, a circuit such as disclosed in the specification of U.S. Pat. No. 4,114,495 or application No. 929,007, each assigned to the same assignee as the present case, employed.

The chord detection circuit 5 is provided for detecting a chord on the basis of a key being depressed in the lower keyboard. In the present embodiment, the lower keyboard is utilized as a keyboard for conducting the automatic bass/chord performance. The chord detection circuit 5 has storage positions corresponding to the respective notes. When a block including a key switch of the lower keyboard has been extracted in the block detection circuit 2 and a signal representing the note of the key switch which is on has been outputted from the note detection circuit 4, this signal representing the note of the key which is being depressed in the lower keyboard is stored in a corresponding one of the storage positions of the chord detection circuit 5 with the aid of a load signal LL which is applied from the control signal forming circuit 11.

Upon completion of extraction of all the blocks including the function switches and key switches which are on by the block circuit 2 and extraction of the signal from the storage position for the automatic bass/chord processing, a shift signal SL is applied to the chord detection circuit 5 from the control signal forming circuit 11 to successively circulate signals stored in the respective storage positions in the chord detection circuit 5 and representing the notes of the keys being depressed in the keyboard in the direction from the higher note side to the lower note side. In the meanwhile, whether tones of the depressed keys constitute the predetermined chord is detected from a note interval relation between a signal in the storage position of a last stage and signals in other storage positions of the chord detection circuit 5. The signal corresponding to the storage position of the last stage at the time when the constitution of the chord has been detected is used as a signal representing a root note in the chord.

Since a signal "1" is stored in the respective storage positions in the note detection circuit 4 upon extraction of the storage position for the automatic bass/chord processing, signals corresponding to the respective notes are successively outputted from the note detection circuit 4. These signals are synchronized with shifting of the signals loaded in the respective storage positions of the chord detection circuit 5. Accordingly, the signal representing a note and being outputted from the note detection circuit 4 at the time when forming of the chord has been detected is nothing but a signal representing a root note. The note code NC at this time is loaded in the key code register 9 in accordance with a load signal from the control signal forming circuit 11 and thereafter is applied to the key code processing circuit 12 as a note code representing a root note.

The chord detection circuit 5 generates also a chord kind detection signal D representing the kind of the detected chord. This signal D is applied to a subordinate note forming data generation circuit 13. This circuit 13 successively produces a subordinate note forming data SD representing predetermined note intervals on the basis of the chord kind detection signal D and a signal representing a bass pattern from the previously described control data memory.

The key code data processing circuit 12 successively processes, in response to the subordinate note forming data SD supplied from the subordinate note forming data generation circuit 13, the note code NC representing the note code and being applied from the key code register 9, thereby producing key codes KC corresponding to the subordinate notes having predetermined note intervals relative to the root note and supplying these key codes KC to the channel processor.

2. Detailed description of the component parts

Figure 2:
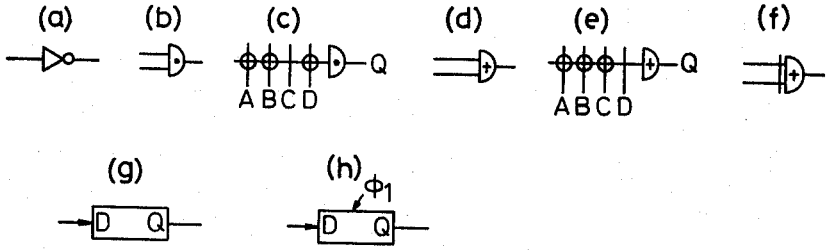
FIG. 2 is a diagram for explaining symbols used in circuits appearing in subsequent figures.

Description will now be made about construction and operation of a specific example of the circuits composing the key code data generator shown in FIG. 1. In this example, the key code data generator schematically shown in FIG. 1 and the channel processor (not shown) are combined in an integrated circuit on a single chip. Logic symbols shown in FIG. 2 are used with respect to the circuits described hereunder. Inverters are designated by symbols shown in FIG. 2(*a*), AND gates by those shown in FIGS. 2(*b*) and 2(*c*), OR gates by those shown in FIGS. 2(*d*) and 2(*e*) and exclusive OR gates by those shown in FIG. 2(*f*). The ordinary symbol shown in FIG. 2(*b*) or 2(*d*) is used for a case where the number of input lines is relatively small in an AND gate or an OR gate and a symbol shown in FIG. 2(*c*) or 2(*e*) is used for a case where the number of input lines is relatively large. In the symbol shown in FIG. 2(*c*) or 2(*e*), a single input line is drawn on the input side of the AND or OR gate several signal lines are drawn so that they will intersect the single input line and intersections of the single input line and the signal lines on which signals are supplied to the AND or OR gate are marked by small circles. The example shown in FIG. 2(*c*) is expressed by a logic equation of Q=A. B.D and the example shown in FIG. 2(*e*) by a logic equation of Q=A+B+C. A delay flip-flop is graphically expressed by a symbol shown in FIG. 2(*g*) or 2(*h*). The delay flip-flop shown in FIG. 2(*g*) which has no representation of a clock pulse is driven by a clock pulse with a period of 48 microseconds (more specifically, a two phase clock pulse), whereas the delay flip-flop shown in FIG. 2(*h*) which has representation of a clock pulse $\phi_1$ is driven by a clock pulse with a period of 1 microsecond (more specifically a two-phase clock pulse).

In this example, the electronic musical instrument includes a pedal keyboard having 26 kinds of function switches and 13 keys ranging from a note $C_0$ of the 0 octave to a note $C_1$ of the first octave, a lower keyboard having 49 keys ranging from a note $C_1$ of the first octave to a note $C_5$ of the fifth octave and an upper keyboard having 49 keys ranging from a note $C_2$ of the second octave to a note $C_6$ of the sixth octave. The key switches corresponding to the respective keys of the pedal keyboard are grouped into a block P, the key switches corresponding to the respective keys of the lower keyboard are grouped into blocks $L_1$, $L_2$, $L_3$ and $L_4$ individually corresponding to each of the octaves and the keys switches corresponding to the respective keys of the upper keyboard are grouped into blocks $U_1$, $U_2$, $U_3$ and $U_4$ also corresponding to each of the blocks. The function switches are suitably distributed to either of two blocks $F_1$ and $F_2$ in such a manner that each of the function switches will correspond to one of the note names C# through C. The state in which the function switches and the key switches are grouped into blocks is shown in the following Table 1.

TABLE 1

| Block | | Notes | | | | | | | | | | | | |
|---|---|---|---|---|---|---|---|---|---|---|---|---|---|---|
| | | CL | C# | D | D# | E | F | F# | G | G# | A | G# | B | C |
| Function | F1 | SF | FC | CA | M | CON | EC | UL | DC | FS | UT | FSS | ST | SS |
| Switch | F2 | BEAT | $V_2$ | $V_1$ | BV | $R_8$ | $R_7$ | $R_6$ | $R_5$ | $R_4$ | $R_3$ | $R_2$ | $R_1$ | RV |
| Pedal keyboard | P | $C_{L0}$ | $C\#_0$ | $D_0$ | $D\#_0$ | $E_0$ | $F_0$ | $F\#_0$ | $G_0$ | $F\#_0$ | $A_0$ | $A\#_0$ | $B_0$ | $C_1$ |
| Lower keyboard | L1 | $C_{L1}$ | $C\#_1$ | $D_1$ | $D\#_1$ | $E_1$ | $F_1$ | $F\#_1$ | $G_1$ | $G\#_1$ | $A_1$ | $A\#_1$ | $B_1$ | $C_2$ |
| | L2 | | $C\#_2$ | $D_2$ | $D\#_2$ | $E_2$ | $F_2$ | $F\#_2$ | $G_2$ | $G\#_2$ | $A_2$ | $A\#_2$ | $B_2$ | $C_3$ |
| | L3 | | $C\#_3$ | $D_3$ | $D\#_3$ | $E_3$ | $F_3$ | $F\#_3$ | $G_3$ | $G\#_3$ | $A_3$ | $A\#_3$ | $B_3$ | $C_4$ |
| | L4 | | $C\#_4$ | $D_4$ | $D\#_4$ | $E_4$ | $F_4$ | $F\#_4$ | $G_4$ | $G\#_4$ | $A_4$ | $A\#_4$ | $B_4$ | $C_5$ |
| Upper keyboard | U1 | $C_{L2}$ | $C\#_2$ | $D_2$ | $D\#_2$ | $E_2$ | $F_2$ | $F\#_2$ | $G_2$ | $G\#_2$ | $A_2$ | $A\#_2$ | $B_2$ | $C_6$ |
| | U2 | | $C\#_3$ | $D_3$ | $D\#_3$ | $E_3$ | $F_3$ | $F\#_3$ | $G_3$ | $G\#_3$ | $A_3$ | $A\#_3$ | $B_3$ | $C_4$ |
| | U3 | | $C\#_4$ | $D_4$ | $D\#_4$ | $E_4$ | $F_4$ | $F\#_4$ | $G_4$ | $G\#_4$ | $A_4$ | $A\#_4$ | $B_4$ | $C_5$ |
| | U4 | | $C\#_5$ | $D_5$ | $D\#_5$ | $E_5$ | $F_5$ | $F\#_5$ | $G_5$ | $G\#_5$ | $A_5$ | $A\#_5$ | $B_5$ | $C_6$ |

Reference character SF represents a signal used for selecting a single finger function in an automatic accompanyment function, i.e., a function of automatically performing chord tones consisting of a plurality of tones by depressing a single key corresponding to a root note in the lower keyboard (the chord tone performing keyboard) and designating a kind of chord by a suitable means, simultaneously performing automatically bass tones corresponding to the chord tones. FC represents signal for selecting a finger function, i.e., a function of depressing a plurality of keys in the lower keyboard in the form of a chord for automatically performing the chord tones and simultaneously performing bass tones corresponding to the chord. CA represents a signal for selecting a custom function, i.e., a function of automatically performing chord tone in accordance with tones of keys depressed in the form of a chord in the lower keyboard and automatically performing bass tones using a tone of a single key depressed in the pedal keyboard as a root tone of the base tones. M represents a signal for selecting a memory function, i.e., a function of repeating an automatic performance even after release of depression of keys in the lower keyboard. CON represents a signal for selecting a constant function, i.e., a function of maintaining the chord tones and the bass tones as sustained tones. EC represents an envelope control signal for selecting two types of envelope shapes. UL represents a coupler signal for producing tones from the upper keyboard and the lower keyboard simultaneously. DC represents a damping control signal for sharply attenuating levels of tones to be produced. The signal FS is a signal supplied from a foot switch. UT represents a signal for selecting an up mode in the automatic arpeggio performance in which the tone pitch of tones to be produced rises one tone after another and a turn mode in which the tone pitch repeatedly rises and falls. FSS represents a foot switch select signal for selecting what is to be selected by the signal FS from the foot switch. ST represents a rhythm start signal for starting the automatic rhythm performance. SS represents a signal for selecting a "synchro-start" function according to which the automatic rhythm performance device and the automatic bass/chord performance device are started synchronously. RV represents a signal for selecting two kinds of rhythm variations. $R_1$ through $R_8$ represent signal for selecting eight different rhythms, e.g., march, waltz, swing, slow rock, jazz rock, rumba, bosa nova and samba. BV represents a signal for selecting two kinds of bass variations in the automatic bass performance. $V_1$, $V_2$ represent signals for selecting arpeggio variation in the automatic arpeggio performance. BEAT represents a signal for selecting two kinds of tempo.

The numbers attached to the characters representing notes of the respective key switches represent respective octaves. For instance, the signal $C\#_2$ represents note C# in the second octave. The signals $CL_0$, $CL_1$ and $CL_2$ represent note C is 0 octave, first octave and second octave respectively and indicate that they are the lowest tone in the respective keyboards.

Figure 3:
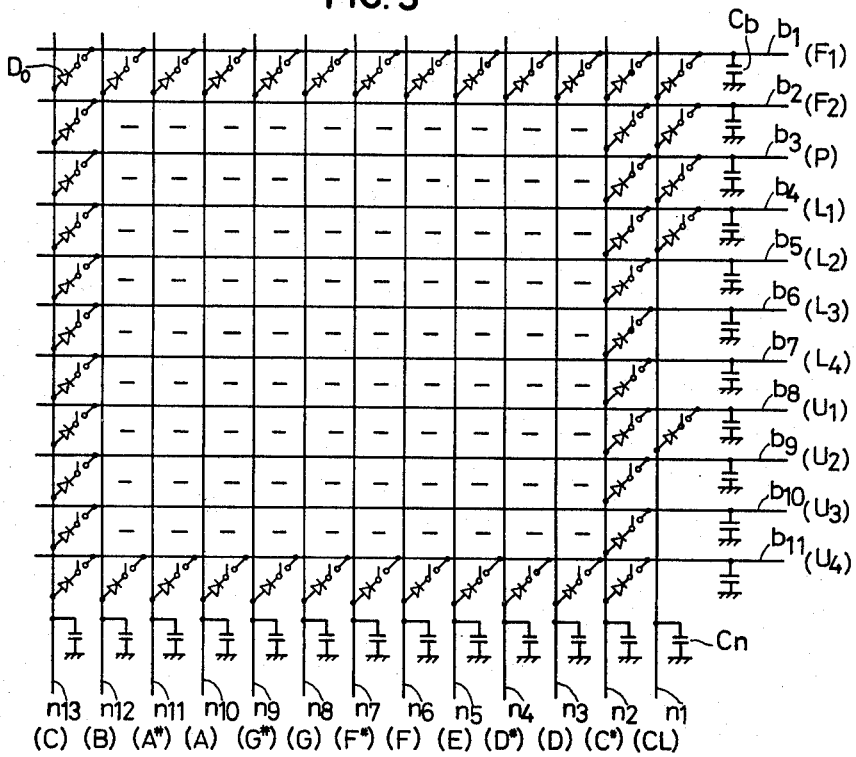
FIG. 3 is a circuit diagram showing an example of connections of key switches and functions switches.

An example of connections of the function switches and key switches grouped into blocks is shown in FIG. 3. One terminal (a stationary contact side) of each of the function switches and key switches of each of the blocks $F_1$, $F_2$, P, $L_1$–$L_4$, $U_1$–$U_4$ is commonly connected to one of block lines $b_1$ through $b_{11}$, whereas the other terminal (a movable contact side) of each of the function switches and key switches corresponding to the same note is commonly connected through a diode to one of note lines $n_1$ through $n_{13}$. Reference character $C_b$ represents conductor capacity of each of the block lines $b_1$ through $b_{11}$ and $c_n$ represents conductor capacity of each of the note lines $n_1$ through $n_{13}$. Detection of the function switches and key switches is made by positively utilizing the conductor capacities $C_b$ and $C_n$.

DETECTION OF THE FUNCTION SWITCHES AND KEY SWITCHES

Figure 4:
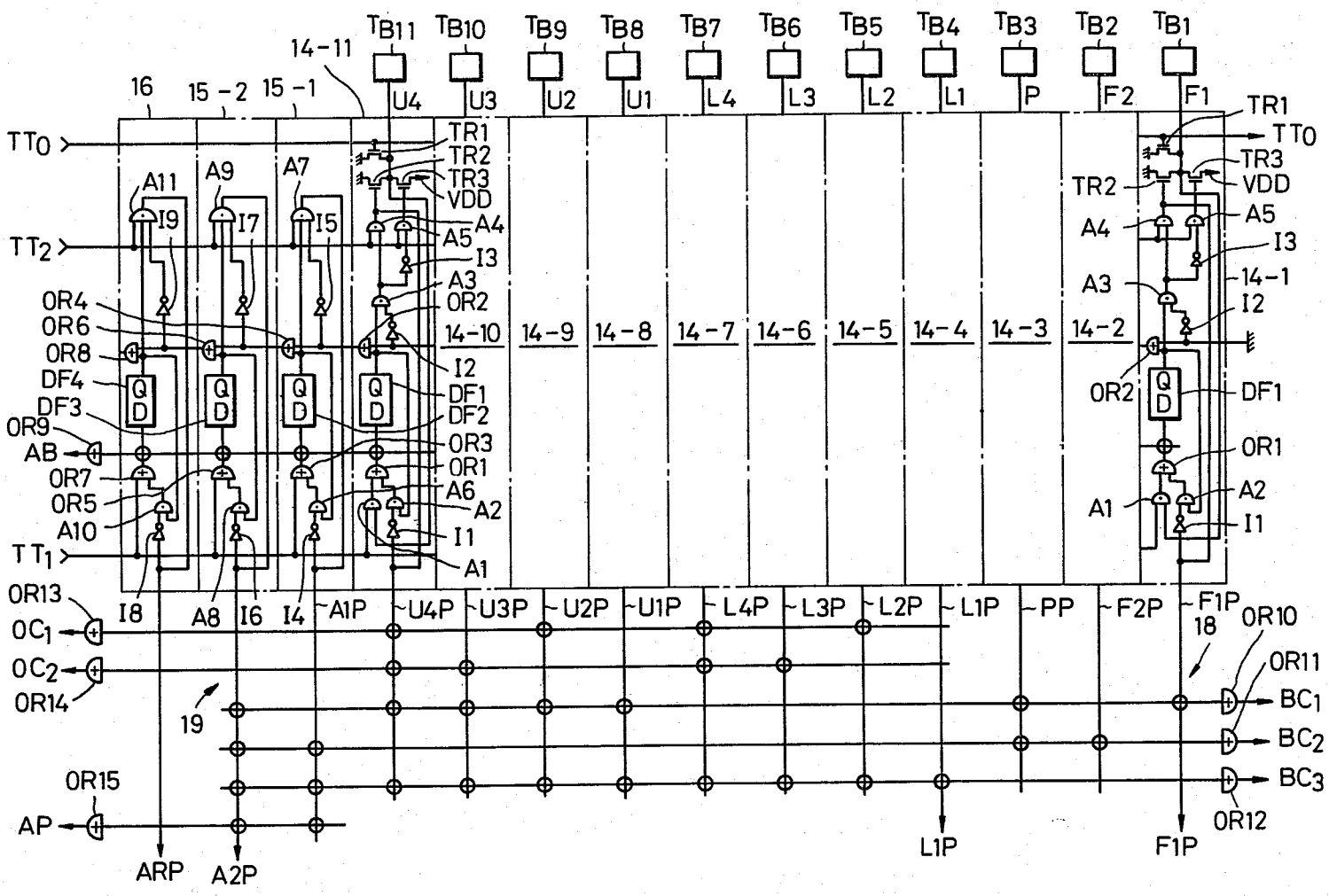
Figure 5:
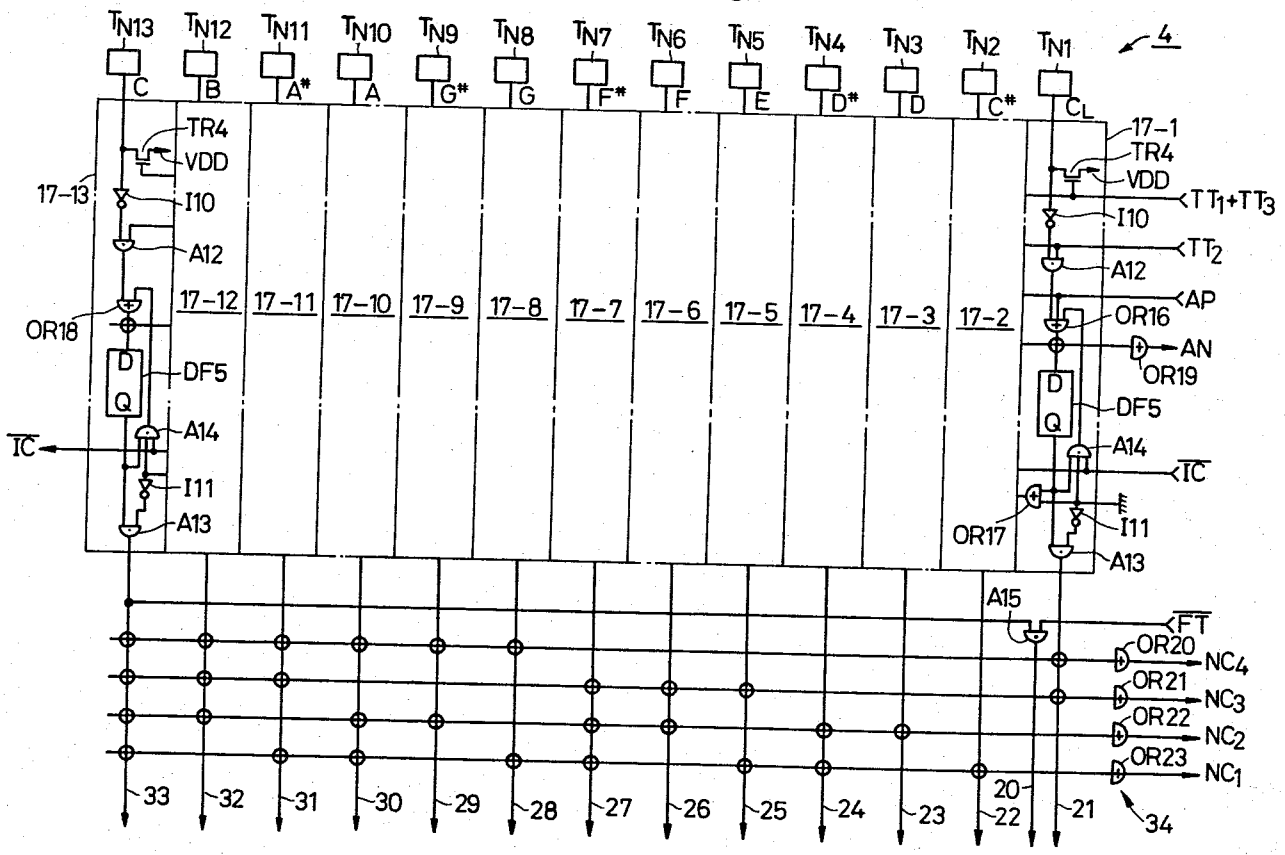

FIG. 4 shows an example of the block detection circuit 2. FIG. 5 an example of the note detection circuit 4 and FIG. 6 an example of the state control circuit 3 which controls the detection operations of the block detection circuit 2 and the note detection circuit 4.

With reference to FIG. 4, the block detection circuit 2 comprises detection circuits 14-1 through 14-11 corresponding to the blocks $F_1$, $F_2$, P, $L_1$–$L_4$ and $U_1$–$U_4$, automatic bass/chord processing circuits 15-1 and 15-2, and an automatic arpeggio-processing circuit 16. Input terminals $T_{B1}$ through $T_{B11}$ of the detection circuits 14-1 through 14-11 are connected to the block lines $b_1$ through $b_{11}$ shown in FIG. 3.

With reference to FIG. 5, the note detection circuit 4 comprises detection circuit 17-1 through 17-13 corresponding to the respective notes $C_L$-C. Input terminals of the detection circuits 17-1 through 17-13 are connected to the note lines $n_1$ through $n_{13}$ shown in FIG. 3.

In FIG. 4, the detection circuit corresponding to the block $F_1$ and the detection circuit 14-11 corresponding to the block $U_4$ only are illustrated in detail among the detection circuits 14-1 through 14-11. It should be noted that the other detection circuits 14-2 through 14-10 corresponding to the blocks $F_2$, P, $L_1$–$L_4$ and $U_1$–$U_3$ are of the same construction as circuits 14-1 and 14-11. Similarly, the detection circuits 17-1 and 17-13 corresponding to the notes $C_L$ and C only are illustrated in detail in FIG. 5, but the other detection circuits 17-2 through 17-12 corresponding to the other notes C# through B are of the same construction as the circuits 17-1 and 17-13 except for some slight difference which is peculiar to the detection circuit 17-13 corresponding to the note C. Throughout the detection circuits 14-1 through 14-11 and 17-1 through 17-13, component elements (AND gates, OR gates etc.) of these circuits performing the same function are designated by the same reference characters regardless of difference in the block or note.

Figure 6:
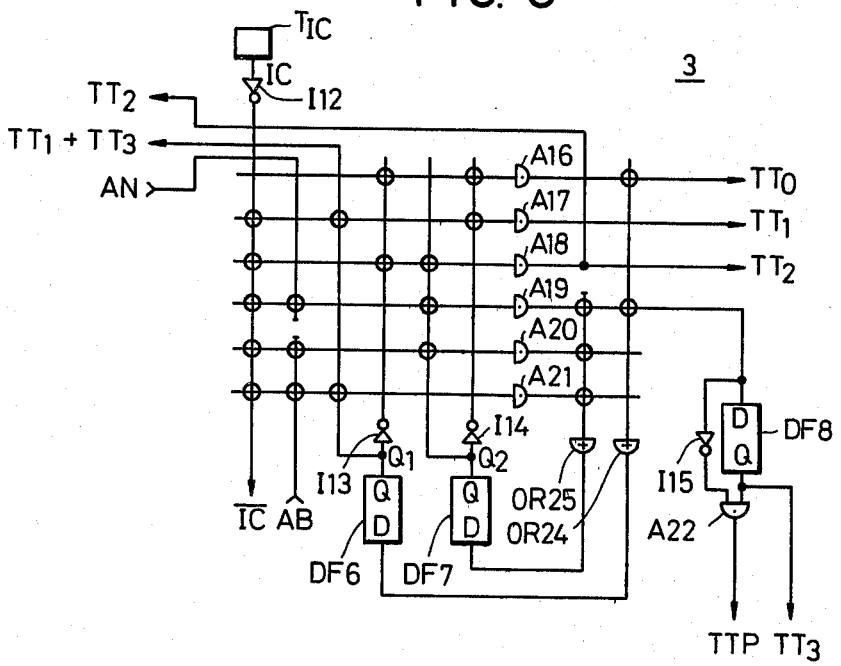

The block detection circuit 2 and the note detection circuit 4 shown in FIGS. 4 and 5 are controlled by carrying out the four states $S_0$–$S_3$ produced by the state control circuit 3 shown in FIG. 6. Which one of the four stages $S_0$–$S_3$ is presently being carried out is indicated by contents of output signals $Q_1$ and $Q_2$ of flip-flops $DF_6$ and $DF_7$ provided in the state control circuit 3. The relationship between contents of the signals $Q_1$ and $Q_2$ and the operation states $S_0$–$S_4$ is shown in the following Table 2.

2

| State | $Q_1$ | $Q_2$ |
|---|---|---|
| $S_0$ | 0 | 0 |
| $S_1$ | 1 | 0 |
| $S_2$ | 0 | 1 |
| $S_3$ | 1 | 1 |

With reference to FIG. 6, an initial clear signal IC which is a positive pulse is applied to a terminal $T_{IC}$. This signal IC is inverted by an inverter $I_{12}$ and the inverted signal "0" is applied to AND gates $A_{17}$ through $A_{21}$. The initial clear signal IC is generated at a suitable time such as wehn the power switch is turned on and is used for once clearing the entire system. Accordingly, the output of the AND gates $A_{17}$ through $A_{21}$ are all turned to "0" and so are the outputs $Q_1$ and $Q_2$ of the delay flip-flops $DF_6$ and $DF_7$. The AND gates $A_{16}$ to which the outputs of the delay flip-flops $DF_6$ and $DF_7$ inverted by inverters $I_{13}$ and $I_{14}$ are applied produces a signal $TT_0$ which represents the state $S_0$. This signal $TT_0$ is applied to the gates of MOS type field-effect transistors (hereinafter referred to as "the transistors") $TR_1$ (FIG. 4) in the detection circuits 14-1 through 14-11 of the block detection circuit 2 to turn on all of the transistors $TR_1$ and thereby cause the conductor capacities $C_b$ (FIG. 3) of the block lines $b_1$ through $b_{11}$ to discharge.

The output of the AND gate $A_{16}$ is applied to the delay flip-flop $DF_6$ through an OR gate $OR_{24}$ and the output $Q_1$ of the delay flip-flop $DF_6$ rises to "1" at a timing of a next clock pulse. At this time, the output $Q_2$ of the delay flip-flop $DF_7$ remains in the "0" level. This enables the AND gate $A_{17}$ which thereupon produces an output $TT_1$ representing the state $S_1$. Simultaneously, the output $Q_1$ of the delay flip-flop $DF_6$ is applied as a signal $TT_1+TT_3$ to the gates of transistors $TR_4$ (FIG. 5) of the detection circuit 17-1 through 17-13 of the note detection circuit 4. All of the transistors $TR_4$ thereby are turned on to supply a power VDD to the note lines $n_1$ through $n_{13}$ via terminals $T_{NL}$–$T_{n13}$. The conductor capacities $C_n$ thereby are charged. If there is a key switch or function switch which is on, the conductor capacity $C_b$ of a block line among the block lines $b_1$ through $b_n$ including the key switch or function switch which is on is charged through this key switch or function switch. As a result, a signal "1" is provided on the block line. (If there are plural switches which are on, signals "1" are provided on corresponding plural block lines). This signal is applied to an AND gate $A_1$ of the corresponding one of the detection circuits 14-1 through 14-11 via one of the input terminals $T_{B1}$ through $T_{B11}$ of the block detection circuits 2. To the other input channel of the AND gate $A_1$ is applied the signal $TT_1$ representing the state $S_1$ which is the output of the AND gate $A_{17}$ of the state control circuit 3.

Accordingly, the AND gate $A_1$ of the detection circuit corresponding to the block including the key switch or function switch which is on only is enabled to provide a signal "1" to a delay flip-flop $DF_1$ through an OR gate $OR_1$. The signal $TT_1$ representing the state $S_1$ is also applied to delay flip-flop $DF_2$ through $DF_4$ of the automatic bass/chord processing circuits 15-1 and 15-2 and the automatic arpeggio processing circuit 16 via corresponding OR gates $OR_3$, $OR_5$, $OR_7$.

The output Q of the delay flip-flop $DF_1$ of the respective detection circuits 14-1 through 14-11 is fed back to a data input D through an AND gate $A_2$ and the OR gate $OR_1$. The output Q of each of the delay flip-flop $DF_2$ and $DF_3$ of the automatic bass/chord processing is fed back to each data input D through an AND gate $A_6$ and an OR gate $OR_3$ and through an AND gate $A_8$ and an OR gate $OR_5$. Likewise, the output Q of the delay flip-flop $DF_4$ of the automatic arpeggio processing circuit 16 is fed back to its data input through an AND gate $A_{10}$ and an OR gate $OR_7$. Each of the delay flip-flops $DF_1$, $DF_2$, $DF_3$ and $DF_4$ constitutes a storage circuit. Accordingly, in the state $S_1$, a signal "1" is stored in the delay flip-flop $DF_1$ of the detection circuit corresponding to a block including a key switch or function switch which is on. No storage of a signal is made in the delay flip-flop $DF_1$ of the other detection circuits to blocks including no key switch or function switch which is on. The delay flip-flop $DF_2$ and $DF_3$ of the automatic bass/chord processing circuits 15-1 and 15-2 and the delay flip-flop $DF_4$ of the automatic arpeggio processing circuit 16 store a signal "1" unconditionally.

The outputs of the OR gates $OR_1$ of the detection circuit 14-1 through 14-11, the OR gates $OR_3$ and $OR_5$ of the automatic bass/chord processing circuits 15-1 and 15-2 and the OR gate $OR_7$ of the automatic arpeggio processing circuit 16 are applied to an OR gate $OR_9$. The OR gate $OR_9$ outputs an any-block signal AB which rises to the level "1" when a signal "1" is applied to any one of the delay flips $DF_1$, $DF_2$, $DF_3$ and $DF_4$ and falls to the level "0" when all of these delay flips are cleared of the signal "1". This any-block signal AB is applied to a data input D of a delay flip-flop $DF_7$ through an OR gate $OR_{25}$ and the output $Q_2$ of the delay flip-flop $DF_7$ is turned to "1" at the timing of a next clock pulse. Since the output of the OR gate $OR_{24}$ is "0" at this time, the output $Q_1$ of the delay flip-flops $DF_6$ is turned to "0". The AND gate $A_{18}$ thereby is enabled and the operation mode is changed to the state $S_2$.

The signal "1" stored in the delay flip-flop $DF_1$ of one of the detection circuits 14-1 through 14-11 of the block detection circuits 2 corresponding to the block including the key switch or function switch which is on is applied to the AND gate $A_3$. The AND gate $A_3$ constitutes a priority circuit. The AND gate $A_3$ of the detection circuit 14-1 corresponding to the block $F_1$ which is given a top priority is unconditionally enabled by applying a signal "1" which is obtained by inverting a signal "0" at a ground level by an inverter $I_2$. Each of the other detection circuits 14-2 through 14-11 receives a signal which is obtained by inverting by an inverter $I_2$ an output of the OR gate $OR_2$ to which the output Q of the delay flip-flop $DF_1$ of the preceding detection circuit and the output of the OR gate $OR_2$ of the preceding detection circuit are applied. The AND gate $A_3$ in each of the detection circuits 14-2 through 14-11 is enabled on condition that none of the delay flip-flops $DF_1$ of the detection circuits of higher priority orders stores a signal "1". If there is storage of the signal "1" in any of the delay flip-flops $DF_1$ of the detection circuits of higher priority orders, the AND gate $A_3$ is disabled.

The output of the AND gate $A_3$ is applied to an AND gate $A_4$ while the output of the AND gate $A_3$ is inverted by an inverter $I_3$ and thereafter is applied to an AND gate $A_5$. The signal $TT_2$ representing the state $S_2$ is applied from the AND gate 18 of the state control circuit 3 to the other inputs of the AND gates $A_4$ and $A_5$. The signals "1" stored in the delay flip-flops $DF_2$ and $DF_3$ of the automatic bass/chord reprocessing circuits 15-1 and 15-2 are applied to AND gates $A_7$ and $A_9$ having three input channels and the signal "1" stored in the delay-flop $DF_4$ in the automatic arpeggio processing circuit 16 is applied to an AND gate $A_{11}$ having three input channels. The AND gate $A_7$ receives at the other input thereof a signal obtained by inverting the output of the OR gate $OR_2$ of the detection circuit 14-11 by an inverter $I_5$ and the signal $TT_2$ representing the state $S_2$. The AND gate $A_9$ receives at the other inputs thereof a signal obtained by inverting by an inverter $I_7$ the output of an OR gate $OR_4$ to which the output Q of the delay flip-flop $DF_2$ of the automatic bass/chord processing circuit 15-1 and the output of the OR gate $OR_2$ of the preceding stage are applied and the signal $TT_2$ representing the state $S_2$. The AND gate $A_{11}$ receives at the other input thereof a signal obtained by inverting by an inverter $I_9$ the output of an OR gate OR6 to which the output Q of the delay flip-flop $DF_3$ of the automatic bass/chord processing circuit 15-2 and the output of the OR gate OR4 of the preceding stage are applied and the signal $TT_2$ representing the state $S_2$. The AND gates $A_7$, $A_9$ and $A_{11}$ thereby constitute a priority circuit. Accordingly, in the state $S_2$, a block of the highest priority among blocks stored in the delay flip-flop $DF_1$ of the detection circuits 14-1 through 14-11 is extracted and only the AND gate $A_4$ of the detection circuit corresponding to the extracted block outputs a signal "1". This signal "1" is applied to the AND gate $A_2$ through the inverter $I_1$ to clear the storage in the delay flip-flop $DF_1$ and also constitutes a block detection output of this detection circuit. The output "1" of the AND gate $A_4$ is also applied to the gate of the transistor $TR_2$ to discharge the conductor capacity $C_b$ of the block line for the extracted block. At this time, the output of the AND gates $A_3$ of the other detection circuits are "0". Accordingly, the AND gate $A_5$ is enabled to apply a signal "1" to the gate of the transistor $TR_3$. As a result, the conductor capacity $C_b$ of the block line for each of the blocks corresponding to the other detection circuits is charged and the diodes D (FIG. 3) connected in series to the key switches or function switches in the other blocks are reversely biased. Accordingly, a signal "0" is provided only on a note line to which the key switch or function switch which is on in the extracted block is connected, the other note lines presenting a signal "1". This signal "0" is inverted by an inverter $I_{10}$ in a corresponding one or ones of the detection circuits 17-1 through 17-13 of the note detection circuit 4 (FIG. 5) and thereafter is applied to an AND gate $A_{12}$. The AND gate $A_{12}$ receives at the other input thereof the signal $TT_2$ representing the state $S_2$ from the state control circuit 3, so that a signal "1" is applied in the state $S_2$ to the data input $D_5$ of the delay flip-flop $DF_5$ via an OR gate $OR_{16}$ or $OR_{18}$. The delay flip-flop $DF_5$ feeds back its output Q to its input D via an AND gate $A_{14}$ and the OR gate $OR_{16}$ or $OR_{18}$ thereby forming a storage circuit. Accordingly, when the signal "1" is applied through the OR gate $OR_{16}$ or $OR_{18}$, this signal "1" is stored in the corresponding delay flip-flop $DF_5$. The output of each of the OR gate $OR_{16}$ or $OR_{18}$ is applied to an OR gate $OR_{19}$. The OR gate $OR_{19}$ produces an "any note" signal AN which rises to "1" upon application of a signal to any of the delay flips $DF_5$ of the detection circuits 17-1 through 17-13 and maintains the level "1" while any one of the delay flip-flops $DF_5$ holds storage of the signal. This "any note" signal AN is applied to an AND gate $A_{19}$ (FIG. 6) of the state detection circuit 3. The AND gate $A_{19}$ there is enabled to provide a signal "1" to a delay flip-flop $DF_7$ through an OR gate $OR_{25}$ and also to the delay flip-flop $DF_6$ through the OR gate $OR_{24}$. Accordingly, the output $Q_1$, $Q_2$ of the delay flip-flops $DF_6$ and $DF_7$ re turned to "1" at a timing of a next pulse, bringing the operation state to the state $S_3$. At this time, the signal $TT_1+TT_3$ is applied to the gates of the transistor $TR_4$ of the detection circuits 17-1 through 17-13 of the note detection circuit 4 thereby charging the conductor capacity Cn of the note line which discharged in the preceding state $S_2$.

The output of each of the delay flip-flops $DF_5$ of the detection circuits 17-1 through 17-13 of the note detection circuit 4 is applied to an AND gate $A_{13}$ which forms a priority circuit. The AND gate $A_{13}$ of the detection circuit 17-1 corresponding to the note $C_L$ of the highest priority is unconditionally enabled by applying a signal "1" obtained by inverting signal "0" of a ground level by an inverter $I_{11}$. Each of the AND gate $A_{13}$ of the other detection circuits 17-2 through 17-13 receives a signal obtained by inverting by the inverter $I_{11}$ the output of the OR gate $OR_{17}$ of the preceding stage to which the output Q of the delay flip-flop $DF_5$ of the preceding stage and the output of the OR gate $OR_{17}$ of the further preceding stage are applied. Each AND gate $A_{13}$ of the detection circuits 17-2 through 17-13 therefore is enabled on condition that no storage is held in any of the delay flip-flops $DF_5$ which are of higher priority orders and disabled if there is storage of a signal "1" in any of the delay flip-flops $DF_5$ of the detection circuits of higher priority orders. Accordingly, the AND gate $A_{13}$ is enabled from the lower tone side in accordance with the priority order and the AND gates $A_{13}$ of the detection circuits including the delay flip-flops $DF_5$ storing a signal "1" successively produces a signal "1". An AND gate $A_{14}$ of the detection circuit 17-1 corresponding to the note $C_L$ receives a signal "0" of the ground level whereas AND gates $A_{14}$ of the detection circuits 17-2 through 17-13 corresponding to the other notes C#-C receive the outputs of OR gates $OR_{17}$ of the detection circuits 17-1 through 17-12 of the previous stages. Simultaneously with outputting of a signal "1" from the detection circuit due to enabling of the AND gate $A_{13}$, the AND gate $A_{14}$ is disabled to clear storage of the delay flip-flop $DF_5$ of the detection circuit.

When the signal "1" has been outputted from all of the AND gates $A_{13}$ of the detection circuits corresponding to the delay flip-flops $DF_5$ in which the storage is made, the storage is cleared from all of the delay flips $DF_5$ and the any note signal AN outputted by the OR gate $OR_{19}$ is turned to "0". This causes the AND gate $A_{19}$ of the state control circuit 3 to be disabled thereby finishing the state $S_3$. As the state $S_3$ has finished, the output $Q_1$ of the delay flip-flop $DF_6$ is turned to "0" again so that the AND gate $A_{18}$ is enabled on condition that the any-block signal AB is being provided by the block detection circuit 4. The operation state therefore is changed to the state $S_2$. The signal $TT_2$ representing the state $S_2$ is applied to the block detection circuit 4 for extraction of a block of a next priority order.

In the above described manner, the block detection signal is outputted in the state $S_2$ from one of the detection circuits 14-1 through 14-10 of the block detection circuit 2 corresponding to the extracted block. In the state $S_3$, the note detection signals representing the key switches or function switches which are on are successively outputted from the detection circuits 17-1 through 17-13 of the note detection circuit 4. The stage $S_2$ and the stage $S_3$ are alternately repeated until storages in the delay flips $DF_1$ of the detection circuits 14-1 through 14-11 of the block detection circuit 2 are all cleared, i.e. until extraction of the blocks detected as the blocks including the key switches or function switches which are on in the initial state $S_1$ is completed.

Figure 7:
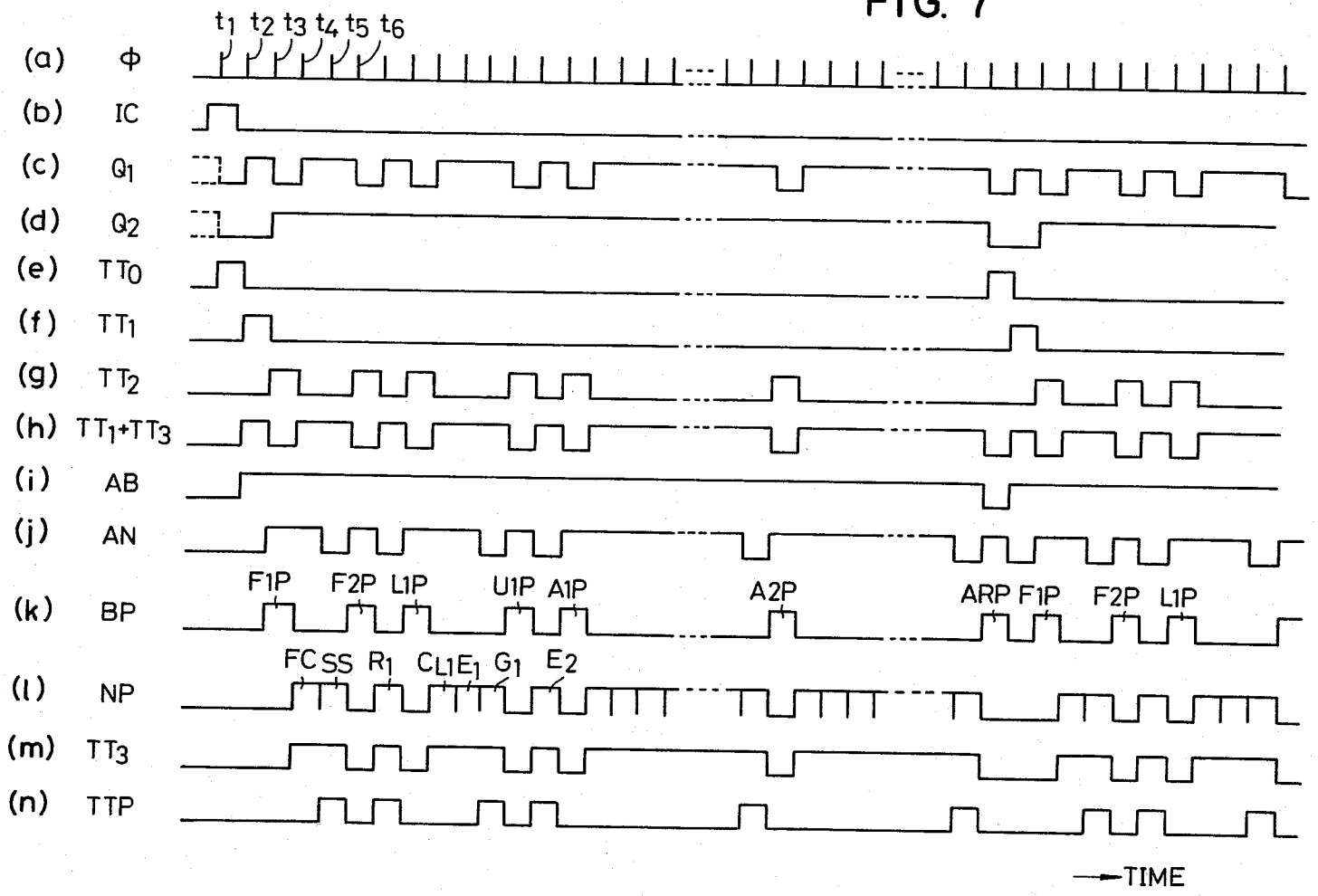

Assume, for example, that function switches corresponding to the signal FC for selecting the finger chord function, the signal SS for selecting the synchro-start function and the signal $R_1$ for selecting a rhythm are being actuated, the keys corresponding to the notes $C_U$, $E_1$ and $G_1$ are being depressed in the lower keyboard and the key corresponding to the note $E_2$ is being depressed. States of signals appearing in the state control circuit 3, an output of the block detection circuit 2 and an output of the note detection circuit 4 in this case are illustrated in the time chart shown in FIGS. 7(*a*) through 7(*n*). FIG. 7(*a*) shows clock pulse times $t_1$ through $t_n$ defined by the clock pulse $\phi$. The signal BP shown in FIG. 7(*d*) represents outputs of the detection circuits 14-1 through 14-11 and the automatic bass/chord processing circuits 15-1 and 15-2 and the automatic arpeggio processing circuit 16. The signal NP shown in FIG. 7(*l*) represents outputs of the detection circuits 17-1 through 17-13 of the note detection circuit 4.

When the initial clear signal IC has been applied to the terminal $T_{IC}$ of the state control circuit 3 as shown in FIG. 7(*b*), the outputs $Q_1$ and $Q_2$ of the delay flip-flops $DF_6$ and $DF_7$ are turned to "0" at the clock pulse time $t_1$ (FIGS. 7(*c*) and 7(*d*) and the signal $TT_0$ representing the state $S_0$ is produced (FIG. 7(*e*). This brings the transistor $TR_1$ of the block detection circuit 2 into conduction with resulting discharge of the conductor capacity $C_b$ of the block lines $b_1$–$b_{11}$. At the next clock pulse time $t_2$, the output $Q_1$ of the delay flip-flop $DF_6$ becomes "1" and the signal $TT_1$ (FIG. 7(*f*)) and the signal $TT_1+TT_3$ (FIG. 7(*h*)) are produced. The transistors $TR_4$ of the note detection circuit 4 are turned on by the signal $TT_1+TT_3$ resulting in charging of the conductor capacity $C_n$ of the note lines $n_1$–$n_{13}$. The AND gates $A_1$ of the block detection circuit 2 is enabled by the signal $TT_1$ and a signal "1" is stored in the delay flip-flops $DF_1$ of the detection circuit 14-1 corresponding to the block $F_1$ including the signal FC for selecting the finger chord and the signal SS for selecting the synchro-start, the detection circuit 14-2 corresponding to the block $F_2$ including the signal $R_1$ for selecting the rhythm, the detection circuit 14-4 corresponding to the block $L_1$ including the notes $C_{LL}$, $E_1$ and $G_1$ of the lower keyboard and the detection circuit 14-8 corresponding to the block $U_1$ including the note $E_2$ of the upper keyboard. The signal "1" is also stored in the delay flip-flops $DF_2$ and $DF_3$ of the automatic bass/chord processing circuits 15-1 and 15-2 and the delay flip-flop $DF_4$ of the automatic arpeggio processing circuit 16. Simultaneously, the any block signal AB is produced from the block detection circuit 2 (FIG. 7(*i*)).

At the clock pulse time $t_3$, the output $Q_2$ of the delay flip-flop $DF_7$ of the state control circuit 3 is turned to "1" whereas the output $Q_1$ of the delay flip-flop $DF_6$ is turned to "0" resulting in generation of the signal $TT_2$ representing the state $S_2$ (FIG. 7(*g*)). This signal $TT_2$ enables the AND gate A4 of the detection circuit 14-1 of the block detection circuit 2 corresponding to the block $F_1$. Consequently, the transistor $TR_2$ is turned on with a result that the block capacity $C_b$ of the block line $b_1$ is discharged and the block detection signal $F_1P$ is produced (FIG. 7(*k*)). The signal $TT_1$ also enables the AND gate $A_{12}$ of the note detection circuit 4 to cause a signal "1" to be stored in the delay flip-flops $DF_5$ of the detection circuits 17-2 and 17-3 corresponding to the signals FC and SS. Simultaneously with this storage of the signal "1", the any-note signal AN outputted by the note detection circuit 4 becomes "1" (FIG. 7(*j*)). At the clock pulse time $t_4$, the operation state is changed to the state $S_3$ and the signals "1" stored in the delay flip-flops $DF_5$ of the note detection circuit 4 are successively outputted from output lines 22 and 33 corresponding to the notes C# and C at clock pulse times $t_4$ and $t_5$ (FIG. 7(*l*)). Upon completion of delivery of the signal from the line 33, the any-note signal AN becomes "0" at the clock pulse time $t_5$, and the output $Q_1$ of the delay flip-flop $DF_6$ in the state control circuit 3 is turned to "0" at the next clock pulse time $t_6$, bringing the operation mode to the state $S_2$. In the foregoing manner, the states $S_3$ and $S_2$ are alternately repeated. Signals $F_2P$, $L_1P$ and $U_1P$ representing the blocks, $F_2$, $F_1$ and $U_1$ are sequentially outputted from the block detection circuit 2 and, in response thereto, the rhythm selecting signal $R_1$, the signals $C_{C1}$, $E_1$ and $G_1$ representing the notes of the lower keyboard and the signal $E_2$ representing the note of the upper keyboard are sequentially outputted from the note detection circuit.

As all of the signals stored in the delay flip-flops $DF_1$ of the detection circuits 14-1 through 14-11 have been extracted, the AND gate $A_7$ of the automatic bass/-chord processing circuit 15-1 is enabled in the state $S_2$, producing a signal "1" as a signal $A_1P$. This signal is inverted by an inverter $I_4$ and thereafter is applied to the AND gate $A_6$ to disable it and thereby to clear the storage in the delay flip-flop $DF_2$. The output $A_1P$ of the automatic bass/chord processing circuit 15 is applied through the OR gate $OR_{15}$ to the OR gates $OR_{16}$ of the detection circuit 17-1 through 17-12 of the note detection circuit 4. Accordingly, a signal "1" is stored in the delay flip-flops $DF_5$ of the detection circuits 17-1 through 17-12 of the note detection circuit 4 when the signal $A_1P$ has been produced from the automatic bass/-chord processing circuit 15-1 of the block detection circuit 2. At this time, the signal AP is not applied to the OR gate $OR_{18}$ of the detection circuit 17-13. This is for avoiding duplication since the detection circuit 17-1 represents the same note C as the detection circuit 17-13. The signals stored in the delay flip-flops $DF_5$ of the detection circuit 17-1 through 17-12 of the note detection circuit 4 are successively outputted from a next clock pulse time in synchronism with each block pulse. Accordingly, a signal "1" is successively provided on the output lines 21 through 32 of the detection circuit 17-1 through 17-12. Upon generation of the signal "1" from the line 32 and turning of the any-note signal AN to "0", the operation state is changed to the state $S_2$ and the AND gate $A_9$ of the automatic bass/-chord processing circuit 15-1 is enabled to provide a signal "1" to the AND gate $A_8$ through the inverter $I_6$ thereby to clear the storage in the delay flip-flop $DF_3$ and produce the signal $A_2P$. This signal $A_2P$ is turned to the automatic bass chord control signal AP through the OR gate $OR_{15}$ and applied to the OR gates $OR_{16}$ of the detection circuits 17-1 through 17-12 of the note detection circuit 4 to cause the delay flip-flops $DF_5$ otoostore a signal "1". Accordingly, a signal "1" is successively produced on the output lines 21 through 32 of the detection circuit 17-1 through 17-12 in synchronism with each block pulse time. This signal "1" produced successively from the detection circuits 17-1 through 17-12 of the note detection circuit 4 in response to the output $A_1P$ and $A_2P$ of the automatic bass/chord processing circuits 15-1 and 15-2 are used for detecting a root note for forming a key code data for the automatic bass/-chord performance as will be described moreffully later.

The AND gate $A_{11}$ of the automatic arpeggio processing circuit 16 subsequently is enabled and its output signal "1" is inverted by the inverter $I_8$ and thereafter is applied to the AND gate $A_{10}$ to clear the storage in the delay flip-flop $DF_4$ and to produce the automatic arpeggio control signal ARP. Upon generation of the signal ARP, the operation state is returned to the state $S_0$ whereby one scanning operation by the block detection circuit 2 and the note detection circuit 4 is completed and the same operation is repeated thereafter.

The output signals $F_1P$ through $A_2P$ of the detection circuit 14-1 through 14-11 and the automatic bass/-chord processing circuits 15-1 and 15-2 of the block detection circuit 2 are applied to an encoder 18. The encoder 18 consists of OR gates $OR_{10}$, $OR_{11}$ and $OR_{12}$ and produces signals $BC_1$, $BC_2$ and BC which constitute a block type code. Relationship between the types of blocks and the block type code $BC_1$–$BC_3$ is shown in the following Table 3:

TABLE 3

| Block | | Block type code | | |
|---|---|---|---|---|
| | | $BC_3$ | $BC_2$ | $BC_1$ |
| Function block | $F_1$ | 0 | 0 | 1 |
| | $F_2$ | 0 | 1 | 0 |
| Pedal keyboard | P | 0 | 1 | 1 |
| Lower keyboard | L | 1 | 0 | 0 |
| Upper keyboard | U | 1 | 0 | 1 |
| Automatic bass/chord processing time | $A_1$ | 1 | 1 | 0 |
| | $A_2$ | 1 | 1 | 1 |

Figure 8:
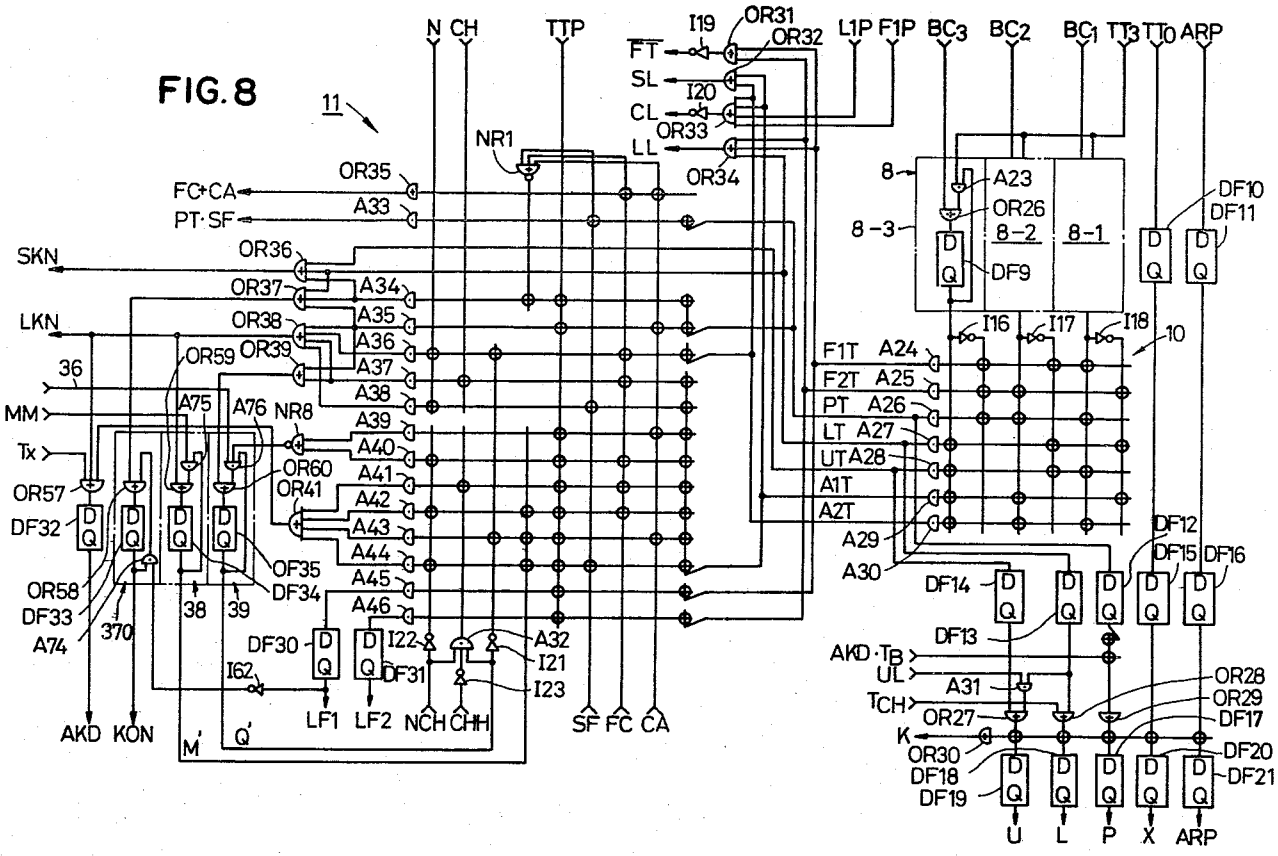

The block type code $BC_1$–$BC_3$ generated by the encoder 18 is applied to the block type code register 8 shown in FIG. 8

The block type code register 8 consists of 3-bit registers 8-1 through 8-3 and, as is representably illustrated in detail in the register 8-3, temporarily holds, during the state $S_3$, the block type code $BC_1$–$BC_3$ delivered from the block detection circuit 2 in the state $S_2$. The block type code $BC_1$–$BC_3$ is applied to the data inputs D of delay flip-flops $DF_9$ through OR gates $OR_{26}$. The outputs Q of the delay flip-flops $DF_9$ are fed back to the data inputs D through AND gates $A_{23}$ and the OR gates $OR_{26}$. The AND gates $A_{23}$ receive at the other inputs thereof the signal $TT_3$ from the state control circuit 3 (FIG. 6). This signal $TT_3$ is a signal obtained by delaying the output of the AND gate $A_{19}$ of the state control circuit 3 by 48 microseconds through a delay flip-flop $DF_8$ and representing the state $S_3$ as shown in FIG. 7(*m*).

The output signals of the block type code register 8 and signals obtained by inverting these output signals by inverters $I_{16}$, $I_{17}$ and $I_{18}$ are applied to the decoder 10. The decoder 10 consists of AND gates $A_{24}$ through $A_{30}$ and generates from the AND gates $A_{24}$ through $A_{30}$ signals $F_1T$ and $F_2T$ representing detection times of the blocks including the function switches, a signal PT representing detection time of the block including the key switches in the pedal keyboard, a signal LT representing detection time of the block including the key switches in the lower keyboard, a signal UT representing detection time of the block including the key switches in the upper keyboard and signals $A_1T$ and $A_2T$ representing an automatic bass/chord processing time. These signals $F_1T$ through $A_2T$ are used in the control signal forming circuit 11 (FIG. 8) to be described later.

The outputs of the AND gates $A_{26}$ through $A_{28}$ of the decoder 10 are delivered out as a signal P representing the key switch in the pedal keyboard, a signal L representing the key switch in the lower keyboard and a signal U representing the key switch in the upper keyboard through delay flip-flops $DF_{12}$ through $DF_{14}$ and delay flip-flops $DF_{17}$ through $DF_{19}$.

The output signals $L_1P$ through $U_4P$ of the detection circuits 14-4 through 14-11 corresponding to the blocks $L_1$ through $L_4$ including the key switches of the lower keyboard and the blocks $U_1$ through $U_4$ including the key switches of the upper keyboard are applied to an encoder 19 consisting of OR gates $OR_{13}$ and $OR_{14}$ (FIG. 4) to be encoded into an octave code $OC_1$, $OC_2$ representing the octave.

The outputs of the detection circuits 17-1 through 17-13 of the note detection circuit 4 are applied to an encoder 34 consisting of OR gates $OR_{20}$, $OR_{21}$, $OR_{22}$ and $OR_{23}$ (FIG. 5) to be encoded into a note code $NC_4$–$NC_1$ representing the note.

Figure 11:
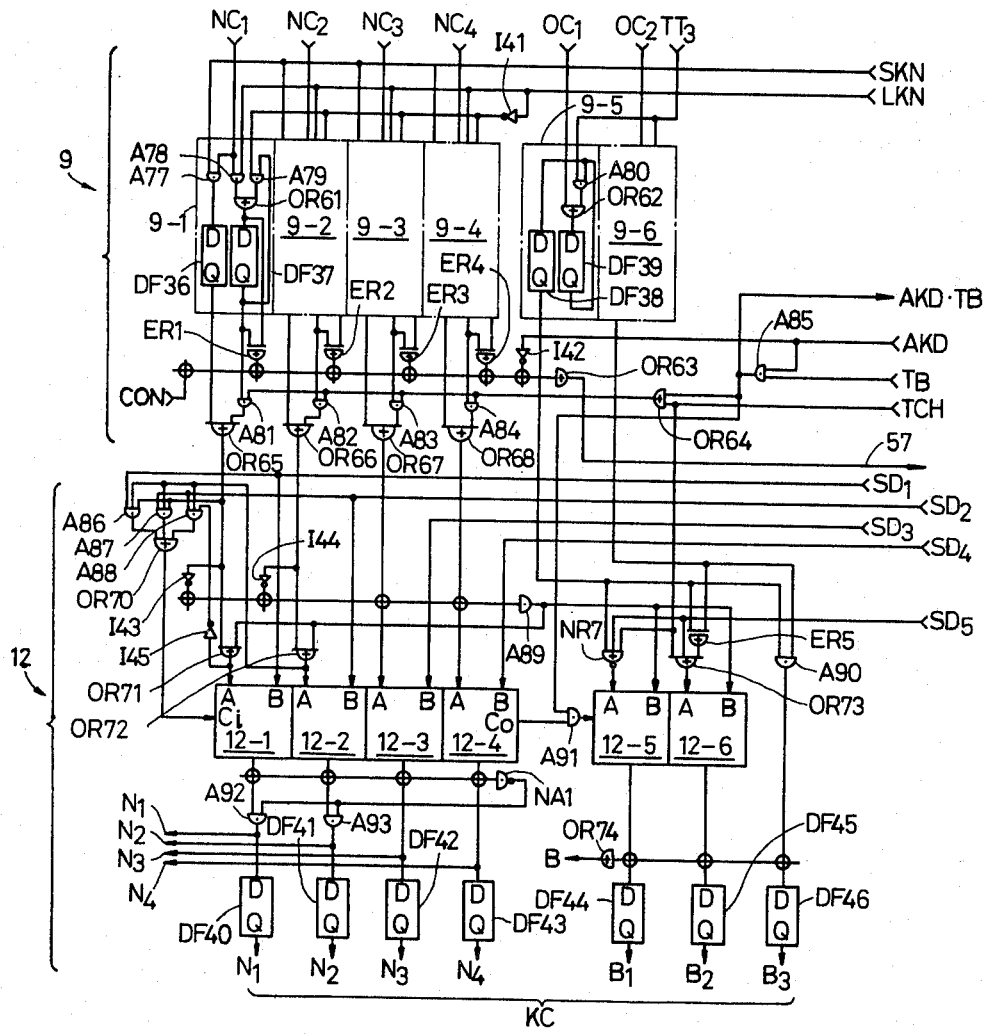

The octave code $OC_1$, $OC_2$ and the note code $NC_1$–$NC_4$ are applied to the key code register 9 shown in FIG. 11. The following Tables 4 and 5 show contents of the octave code $OC_2$, $OC_1$ and the note code $NC_4$–$NC_1$ corresponding to the respective octaves and notes.

TABLE 4

| Octave | Octave code $OC_2$ | $OC_1$ |
|---|---|---|
| 1st octave | 0 | 0 |
| 2nd octave | 0 | 1 |
| 3rd octave | 1 | 0 |
| 4th octave | 1 | 1 |

TABLE 5

| Note | Note code $NC_4$ | $NC_5$ | $NC_2$ | $NC_1$ |
|---|---|---|---|---|
| CL | 1 | 1 | 0 | 0 |
| C# | 0 | 0 | 0 | 1 |
| D | 0 | 0 | 1 | 0 |
| D# | 0 | 0 | 1 | 1 |
| E | 0 | 1 | 0 | 1 |
| F | 0 | 1 | 1 | 0 |
| F# | 0 | 1 | 1 | 1 |
| G | 1 | 0 | 1 | 0 |
| G# | 1 | 0 | 1 | 0 |
| A | 1 | 0 | 1 | 1 |
| A# | 1 | 1 | 0 | 1 |
| B | 1 | 1 | 1 | 0 |

TABLE 5-continued

| Note | Note code $NC_4$ | $NC_5$ | $NC_2$ | $NC_1$ |
|---|---|---|---|---|
| C | 1 | 1 | 1 | 1 |

PROCESSING OF SIGNALS SUPPLIED FROM THE FUNCTION SWITCHES

In the scanning of the key switches and the function switches by the block detection circuit 2 and the note detection circuit 4, the function switches of the blocks F1 and F2 are first detected. Signals $F_1P$ and $F_2P$ corresponding to the blocks F1 and F2 are successively outputted from the block detection circuit 2 and signals representing the function switches which are on in the blocks F1 and F2 are successively outputted from the corresponding detection circuits 17-1 through 17-3 of the note detection circuit 4. The output of the detection circuits 17-1 through 17-12 of the note detection circuit 4 are applied to a note register 35 of the chord detection circuit 5 shown in FIG. 9 through the lines 21 through 35. The output of the detection circuit 17-13 are applied to stages 7-20 and 7-21 of a function data transmission circuit 7 through a delay flip-flop DF29 shown in FIG. 10.

The note register 35 consists of a 12-bit shift register whose respective stages 35-1 through 35-12 are representatively illustrated in detail by the stage 35-1. Each of the stages 35-1 through 35-12 comprises a load controlling AND gate $A_{48}$, a clear control AND gate $A_{49}$ and a shift control AND gate $A_{47}$. The outputs of the AND gates $A_{47}$, $A_{48}$ and $A_{49}$ are applied to a data input of a delay flip-flop $DF_{22}$ through the OR gate $OR_{24}$. The AND gate $A_{48}$ receives signals on the lines 21 through 32 and the load signal LL. The AND gate $A_{49}$ receives the output of the delay flip-flop $DF_{22}$ and the clear signal CL. The AND gate $A_{47}$ receives the output of the delay flip-flops $DF_{22}$ of the preceding stages 35-12 through 35-2 and the shift signal SL. Accordingly, the note register operates to load the signals on the lines 21 through 35 in the corresponding stages 35-1 through 35-12 upon receipt of the load signal LL, clear the signals in the stages 35-1 through 35-12 upon receipt of the clear signal CL and successively shift the signals in the stages 35-12 through 35-2 rightwardly upon receipt of the shift signal SL.

Figure 10:
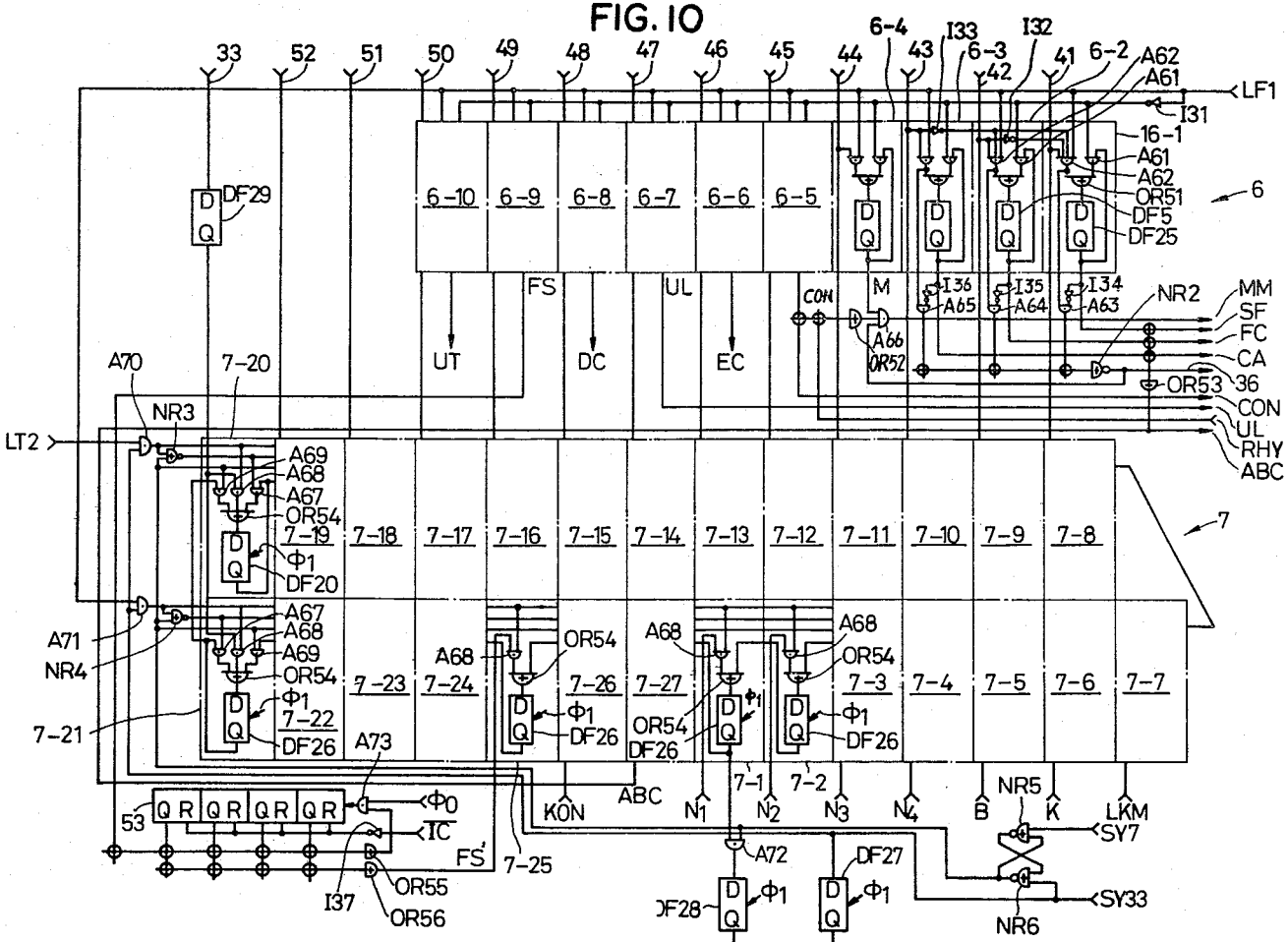

The output $F_1P$ (FIG. 7(*k*) of the block detection circuit 2 which is the first output of the scanning of the block detection circuit 2 and the note detection circuit 4 is applied to an OR gate $OR_{33}$ of the control signal forming circuit 11 (FIG. 8). The output of the OR gate $OR_{33}$ is inverted by an inverter $I_{20}$ and thereafter is applied to the note register 35 as the clear signal CL to clear the signals in the stages 35-1 through 35-12 of the note register 35. The output signal $F_1P$ of the block detection circuit 2 is applied to the block type code register 8 through the encoder 18 and, after being temporarily held in the register 8, is applied to an OR gate 34 through the AND gate $A_{24}$. The output of the OR gate $OR_{34}$ is applied as the load signal LL to the note register 35. Accordingly, the signals including the function switches which are on are successively loaded in the respective stages 35-1 through 35-12 of the note register 35. Signals held in the stages 35-1 through 35-10 which are a part of the signals loaded in the respective stages of the register 35 are applied to function data memories 6-1 through 6-10 (FIG. 10) via lines 41-50. The outputs of the respective stages 35-1 through 35-12 of the note register 35 are applied to the function data transmission circuit 7 (FIG. 10).

The function memories 6-1 through 6-10 are provided for storing signals SF, FC, CA, M, CON, EC, UL, DC, FS and UT from the function switches in the block $F_1$ which is used in this chip. Each of these memories 6-1 through 6-10 which are illustrated in detail respectively by the memories 6-1 through 6-4 comprises an AND gate $A_{61}$ for a clear control, an AND gate $A_{62}$ for a load control and a delay flip-flop $DF_{25}$ to which the outputs of the AND gates $A_{61}$ and $A_{62}$ are applied through an OR gate $OR_{51}$. The AND gate $A_{61}$ receives the output of the delay flip-flop $DF_{25}$ and a signal obtained by inverting a load signal $LF_1$ to be described later by an inverter $I_{31}$. The AND gate $A_{62}$ receives a signal on a corresponding one of the lines 41 through 50 and the load signal $LF_1$. Through the memories 6-1 through 6-1, the AND gates and OR gates which perform the same function are designated by the same reference characters. The memories 6-5 through 6-10 which are not illustrated in detail are of the same construction as the memory 6-4. The memory 6-1 storing the signal SF used for selecting the single finger function and the memory 6-2 storing the signal FC using for selecting the finger chord function are somewhat different from the otehr memories 6-3 through 6-10. In the memory 6-1 the AND gate 62 is inhibited by a signal obtained by inverting the signal on the line 42 by an inverter $I_{32}$. In the memory 6-2 the AND gate $A_{62}$ is inhibited by a signal obtained by inverting the signal on the line 43 by an inverter $I_{33}$.

The load signal $LF_1$ for controlling the function data memories 6-1 through 6-10 is formed by the control signal forming circuit 11 shown in FIG. 8. Referring to FIG. 8, the output signal $F_1T$ of the AND gate $A_{24}$ decoded by the decoder 10 is applied to an AND gate $A_{45}$. The AND gate $A_{45}$ receives at the other input thereof a signal TTP from the state control circuit 3 shown in FIG. 6. This signal TTP is provided by the AND gate $A_{22}$ which receives a signal obtained by inverting the outut of the AND-gate $A_{19}$ by an inverter $I_{15}$ and the output of the delay flip-flop $DF_8$. As shown in FIG. 7(M), the signal TTP is "1" during the last 48 microseconds of the signal $TT_3$ representing the state $S_3$. Accordingly, the AND gate $A_{45}$ is enabled during the last 48 microseconds of the state $S_3$. The output of the AND gate $A_{45}$ is delayed by 48 microseconds by a delay flip-flop $DF_{30}$ and applied to the function data memories 6-1 through 6-10 shown in FIG. 10 as the load signal $LF_1$. In this manner, the signals representing the function switches which are on in the block $F_1$ are stored in the memories 6-1 through 6-10. The signal UL stored in the function data memory 6-7 is applied to the AND gate $A_{31}$ in FIG. 8 where it is used for coupling the upper keyboard tones with the lower keyboard tones. The function data transmission circuit 7 temporarily stores required function data and transmits the data to other chips (not shown). The circuit 7 is composed of a shift register with 27 stages 7-1 through 7-27. In the circuit 7, AND gates, OR gates, delay flip-flops etc. in the respective stages which perform the same function are designated by the same reference characters. The delay flip-flops in the circuit 7 are all operated by a clock pulse $\phi_1$ with a period of 1 microsecond. The stages 7-21 through 7-24 respectively store the signals SS, ST, FSS and UT from the function switches included in the block $F_1$ and their details are illustrated representatively by the stage 7-21. The respective stages 7-21 through 7-24 comprise an AND gate $A_{68}$ for a load control, an AND gate $A_{67}$ for a clear control and an AND gate $A_{69}$ for a shift control. The outputs of the AND gates $A_{67}$, $A_{68}$ and $A_{69}$ are applied to a delay flip-flop $DF_{26}$ through an OR gate $OR_{54}$.

The stages 7-25 through 7-27 respectively store a signal FS' from the foot switch which signal has been freed from the influence of chattering, a key-on signal KON representing that a key switch in the pedal or lower keyboard is on and a signal ABC representing that either one of the single finger function, the finger chord function and the custom function which are different modes of the automatic bass/chord function has been selected. These stages comprise, as representatively shown by the stage 7-25, the load control AND gate $A_{68}$ and the output of the AND gate $A_{68}$ and the output of the delay flip-flop $DF_{26}$ of a preceding stage are applied to the delay flip-flop $DF_{26}$ through the OR gate $OR_{54}$. The foot switch signal FS' is obtained by applying the signal FS from the foot switch stored in the above described function data memory 6-9 to a 4-bit shift register 53 through an OR gate $OR_{55}$ and an AND gate $A_{73}$ which is enabled by a pulse signal $\phi_0$ with a pulse width of 48 microseconds and a pulse period of 1 millisecond, and whenever a signal "1" is outputted from the respective bits of the shift register 53, taking out this signal through an OR gate $OR_{56}$ thereby eliminating the influence of chattering. The key-on signal KON is a signal temporarily held in the key-on register 37 (FIG. 8) as will be described more fully later. The automatic bass/chord selection signal ABC is a signal from an OR gate $OR_{53}$ which is turned to "1" if a signal "1" is stored in any one of the function data memories 6-1, 6-2 and 6-3. The stages 7-1 through 7-7 are of a similar construction to the stages 7-25 through 7-27 and comprise, as representably illustrated by the stages 7-1 and 7-2, the load control AND gate $A_{68}$ and the output of this AND gate $A_{68}$ and a signal from the delay flip-flop $DF_{26}$ of a preceding stage are applied to the delay flip-flop $DF_{26}$ through the OR gate $OR_{54}$. The respective stages 7-1 through 7-7 receive a signal B from an OR gate $OR_{74}$ (FIG. 11) representing that the note data $N_1$–$N_4$ and the octave data $B_1$–$B_3$ are generated in a circuit shown in FIG. 11 to be described in detail later, a signal K representing that the block kind data U-ARP is generated in an OR gate $OR_{30}$ shown in FIG. 8 and a signal LKM representing that a signal is stored in the note register 35 shown in FIG. 9. The signals applied to the stages 7-1 through 7-6 are utilized for testing the circuit.

The stages 7-8 through 7-20 store signals from the founction switches in the block $F_2$. They comprise, as representably illustrated by the stage 7-20, a load control AND gate $N_{68}$ a clear control AND gate $A_{67}$ and a shift control AND gate $A_{69}$. The outputs of the AND gates $A_{67}$, $A_{68}$ are applied to a delay flip-flop $DF_{26}$ through an OR gate $OR_{54}$.

Figure 13:
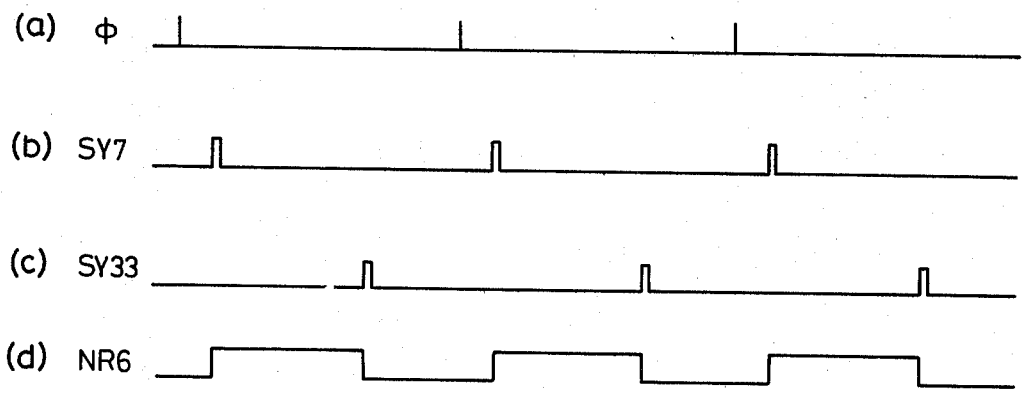
FIG. 13 is a time chart for explaining the operation of the function data transmission circuit.

The load control AND gates $A_{68}$ in the respective stages 7-21 through 7-27 and 7-1 through 7-7 are controlled by the outputs of AND gates $A_{71}$ (FIG. 10). This AND gate $A_{71}$ receives the load signal $LF_1$ designating timing of loading of the signals to the function data memories 6-1 through 6-10 and a synchronizing signal $SY_{33}$. As shown in FIG. 13(*c*), the synchronizing signal $SY_{33}$ is generated at the thirty-third microsecond in the clock pulse time of 48 microseconds (FIG. 13(*a*), FIG.

7(*a*)) determined by the clock pulse $\phi$. The signal $SY_{33}$ has a period of 48 microseconds, the same as that of the clock pulse $\phi$, and a pulse width of 1 microsecond. Accordingly, signals being applied to the stages 7-21 through 7-27 and 7-1 through 7-7 are loaded therein at a timing of the synchronizing signal $SY_{33}$ when the signal $LF_1$ is being applied to these stages.

The load control AND gates $A_{68}$ in the stages 7-8 through 7-20 are controlled by the outputs of AND gate $A_{70}$. The AND gate $A_{70}$ receives a signal $LF_2$ and the above described synchronizing signal $SY_{33}$. The signal $LF_2$ is formed by the control signal forming circuit 11 shown in FIG. 8. More specifically, the output of an AND gate $A_{46}$ enabled upon receipt of the signal $F_2T$ which is the output of the AND gate $A_{25}$ of the decoder 10 and the signal TTP, i.e., the pulse signal outputted in the last 48 microseconds of the state $S_3$ during which the signals representing the function switches which are on in the block $T_2$ are outputted from the note detection circuit 4 (FIG. 5) is delayed by a delay flip-flop $DF_{31}$ by 48 microseconds and this output of the delay flip-flop $DF_{31}$ constitutes the signal $LF_2$. Accordingly, signals being applied to the stages 7-8 through 7-20 from the lines 41-52 and the delay flip-flop $DF_{29}$ are loaded therein at a timing of the synchronizing signal $SY_{33}$ when the signal $LF_2$ is being applied to these stages.

The function data transmission circuit 7 outputs signals stored in the stages 7-1 through 7-27 from the output terminal of the delay flip-flop $DF_{26}$ of the stage 7-1 as a serial data signal by successively shifting these signals. The shift signal applied to the function data transmission circuit 7 is formed by a flip-flop composed of NOR gates $NR_5$ and $NR_6$. The NOR gate $NR_5$ receives a synchronizing signal $SY_7$ (FIG. 13(*b*)) generated at the seventh microsecond of the clock pulse time determined by the clock pulse $\phi$(FIG. 13(*a*)) while the NOR gate $NR_6$ receives the synchronizing signal $SY_{33}$ (FIG. 13(*c*)). Accordingly, the output of the NOR gate $NR_6$ rises in synchronism with the synchronizing signal $SY_7$ as shown in FIG. 13(*d*) and falls in synchronism with the synchronizing signal $SY_{33}$. This signal is applied to the shift control AND gate $A_{67}$ of the stages 7-1 through 7-27 to shift the signals successively in the respective stages in a clockwise direction (i.e., from the stage 7-27 toward the stage 7-1). These successively shifted signals are outputted from the delay flip-flop $DF_{26}$ of the stage 7-1 and is applied to the AND gate $A_{72}$. The AND gate $A_{72}$ receives at the other input thereof the output of the NOR gate $NR_6$. Accordingly, the AND gate $A_{72}$ outputs, during the synchronizing signals $SY_7$ to $SY_{33}$, serial function data FD consisting of signals LKM, BEAT, $V_2$, $V_1$, BV, $R_8$-$R_1$, RV, SS, ST, FSS, UT, FS, KON and ABC in the order described. This signal FD is delayed by a delay flip-flop $DF_{28}$ by 1 microsecond, inverted by an inverter $I_{39}$ and thereafter is delivered from a terminal $T_{FD}$ as a function data $\overline{FD}$. The outputs of the NOR gate $NR_6$ and the AND gate $A_{71}$ are applied to the clear control AND gates $A_{67}$ of the stages 7-21 through 7-24 via the NOR gate $NR_4$, and the outputs of the NOR gate $NR_6$ and the AND gate $A_{70}$ are applied to the clear control AND gates $A_{67}$ of the stages 7-8 through 7-20 via the NOR gate $NR_3$ respectively for clearing the previously stored signals.

The synchronizing signal $SY_{33}$ is delayed by a delay flip-flop $DF_{27}$ by 1 microsecond, inverted by an inverter $I_{39}$ and thereafter is delivered out as a synchronizing signal $\overline{SY}$.

GENERATION OF KEY CODE DATA REPRESENTING THE DEPRESSED KEY

Upon extraction of the blocks $F_1$ and $F_2$ including the function switches in the block detection circuit 2, the block P including the key switches of the pedal keyboard is extracted and, in response thereto, the AND gate $A_{26}$ of the decoder 10 (FIG. 8) is enabled to produce the signal PT. If none of the signals SF, FC and CA for selecting the automatic bass chord function is generated, the output of the NOR gate $NR_1$ is "1" and the AND gate $A_{34}$ is enabled when the signal TTP is present. This output of the AND gate $A_{34}$ is applied through the OR gate $OR_{36}$ to the key code register 9-1 through 9-4 (FIG. 11) as a key data selection signal SKN.

If the blocks $L_1$ through $L_4$ including the key switches of the lower keyboard have been selected, the AND gate $A_{27}$ of the decoder 10 is enabled to produce the signal LT. If the blocks $U_1$ through $U_4$ including the key switches of the upper keyboard have been selected, the AND gate $A_{28}$ of the decoder 10 is enabled to produce the signal UT. The signal LT and UT are applied through the OR gate $OR_{36}$ to the key code registers 9-1 through 9-4 as the key data selection signal SKN.

The key code registers 9-1 through 9-4 are provided for temporarily holding the note code $NC_1$–$NC_4$ generated by the note detection circuit 4 (FIG. 5). Details of the key code registers 9-1 through 9-4 are representatively illustrated by the register 9-1. AND gates and OR gates performing the same function are designated by the same reference characters throughout the registers 9-1 through 9-4.

The key code data selection signal SKN is applied to load control AND gates $A_{77}$ of the key code registers 9-1 through 9-4 to enable these AND gates $A_{77}$. The note code $NC_1$–$NC_4$ is thereby applied to delay flip-flops $DF_{36}$. The note $NC_1$–$NC_4$ is delayed by 48 microseconds by the delay flip-flop $DF_{36}$ and thereafter is applied to inputs A of the adders 21-1 through 12-4 via OR gates $OR_{65}$ through $OR_{68}$ while the outputs of OR gates $OR_{65}$ and $OR_{66}$ are applied to the inputs A of the adders 12-1 through 12-4 via OR gates $OR_{71}$ and $OR_2$.

The key code registers 9-5 and 9-6 receive the octave codes $OC_1$ and $OC_2$ generated in response to extraction of the blocks $L_1$ through $L_4$ and $U_1$ through $U_4$ from the block detection circuit 2 (FIG. 4). The key code registers 9-5 and 9-6 temporarily hold the octave codes $OC_1$ and $OC_2$. The registers 9-5 and 9-6 are of the same construction and are representatively shown by the register 9-5. The octave codes $CO_1$ and $CO_2$ are applied to a data input D of a delay flip-flop $DF_{39}$ through the OR gate $OR_{62}$. The output Q of the delay flip-flop $DF_{39}$ is fed back to the input D through an AND gate $A_{80}$ and the OR gate $OR_{62}$ and also is applied to a delay flip-flop $DF_{38}$. The AND gate $A_{80}$ receives at the other input thereof the signal $TT_3$ representing the state $S_3$. Accordingly, the applied octave codes $OC_1$ and $OC_2$ are held during the state $S_3$.

The signal held in the key code registers 9-5 through 9-6 is a 2-bit signal and this signal is converted to a 3-bit signal in the following manner. The output of the key code register 9-5 is inverted by the NOR gate $NR_7$ and constitutes the first bit signal $B_1$. The outputs of the key code registers 9-5 and 9-6 constitute the second bit signal $B_2$ by inputting these outputs to an exclusive OR gate $ER_5$. The outputs of the key code registers 9-5 and 9-6 constitute the third bit signal by inputting these outputs to an AND gate $A_{90}$. Relationship between the first through third bit signals $B_1$, $B_2$, $B_3$ and the octave codes $OC_1$, $OC_2$ is shown in the following Table 6.

TABLE 6

| | $OC_2$ | $OC_1$ | $B_3$ | $B_2$ | $B_1$ |
|---|---|---|---|---|---|
| 1st octave | 0 | 0 | 0 | 0 | 1 |
| 2nd octave | 0 | 1 | 0 | 1 | 0 |
| 3rd octave | 1 | 0 | 0 | 1 | 1 |
| 4th octave | 1 | 1 | 1 | 0 | 0 |

The first bit signal $B_1$ is applied to an input A of the adder 12-5 and the second bit signal $B_2$ is applied to an input A of the adder 12-6.

The adders 12-1 through 12-6 add the signal applied to the input A and hte signal applied to the input B together. At this time, no signal is applied to the inputs B of the adders 12-1 through 12-4. Accordingly, the signals applied to the adders 12-1 through 12-4 are outputted in their original form from these adders. If, however, the outputs of the delay code registers 9-1 through 9-4 are the note code $NC_4$-$NC_1$ "1100" representing CL, i.e. the low tone side note C, an AND gate $A_{89}$ to which a signal obtained by inverting the output of the OR gate $OR_{65}$ by an inverter $I_{43}$, a signal obtained by inverting the output of the OR gate $OR_{66}$ by an inverter $I_{44}$ and the outputs of the OR gates $OR_{67}$ and $OR_{68}$ are applied is enabled to provide a signal "1" to the inputs A of the adders 12-1 and 12-2 through OR gates $OR_{71}$ and $OR_{72}$ and thereby converting the code signal ($NC_4$-$NC_1$) applied to the inputs A of the adders 12-1 through 12-4 to a code signal "1 1 1 1" representing C, i.e. the high tone side note C. At this time, the output "1" of the AND gate $A_{89}$ is applied to the inputs B of the adders 12-5 and 12-6 thereby adding "1" to the first bit signal and the second bit signal representing the octave.

The outputs of the adders 12-1 through 12-2 are applied to delay flip-flops $DF_{40}$ and $DF_{41}$ through AND gates $A_{92}$ and $A_{93}$ while the outputs of the adders 12-3 and 12-4 are applied directly to delay flip-flops $DF_{42}$ and $DF_{43}$. When the outputs of the adders 12-1 through 12-4 are "1111" representing the note C of the high tone side, the output of a NAND gate $NA_1$ to which the outputs of the adders 12-1 through 12-4 are applied is turned to "0". The AND gates $A_{92}$ and $A_{93}$ are therefore disabled and the code signal is changed to "1100" representing $C_L$, i.e., the note C of the low tone side.

The outputs of the adders 12-5 and 12-6 are applied to delay flip-flops $DF_{44}$ and $DF_{45}$ and the output of the AND gate $A_{90}$ is applied to a delay flip-flop $DF_{46}$.

In the above described manner, the delay flip-flops $DF_{40}$ through $DF_{43}$ produce the note data $N_1$-$N_4$ representing a note whereas the delay flip-flops $DF_{44}$ through $DF_{46}$ produce the octave data $B_1$-$B_3$ representing an octave.

Assume, for example, that the note code $NC_4$-$NC_1$ "1100" representing the note $C_L$ is loaded in the note registers 9-4 through 9-1 and the octave code $OC_2$, $OC_1$ "0 0" representing the first octave is loaded in the note registers 9-6 and 9-5. In this case, an AND gate $A_{84}$ is enabled to apply the code signal "1111" to the inputs A of the adders 12-4 through 12-1 and the output "1111" of the adders 12-4 through 12-1 is changed to the code signal "1100" again by enabling of the NAND gate $NA_1$. At this time, a signal "10" is applied to the inputs A of the adders 12-6 and 12-5 and a signal "11" is applied to the inputs B of the adders 12-6 and 12-5. Accordingly, the adders 12-6 and 12-5 produce an output "00". At this time, the output of the AND gate $A_{90}$ is "0". The delay flip-flops $DF_{43}$ through $DF_{40}$ therefore output note data $N_4$-$N_1$ "1100" whereas the delay flip-flops $DF_{46}$ through $DF_{44}$ produce octave data $B_3$-$B_1$ "000". When the note code $NC_4$-$NC_1$ representing the low tone side note $C_L$ is loaded in the note register 9-1 through 9-6, the note data $N_4$-$N_1$ is "1100" and the octave data $B_3$-$B_1$ is "000".

When the note code $NC_4$-$NC_1$ "1111" representing the high tone side note C is loaded, the NAND gate $NA_1$ is enabled and the note data $N_4$-$N_1$ thereupon is turned to "1100". Since, however, no signal is applied at this time to the inputs B of the adders 12-5 and 12-6, the octave data $B_1$-$B_3$ representing an octave does not change. The note data $N_4$-$N_1$ and the octave data $B_3$-$B_1$ constitute the key code data KC.

CHORD DETECTION

Figure 9:
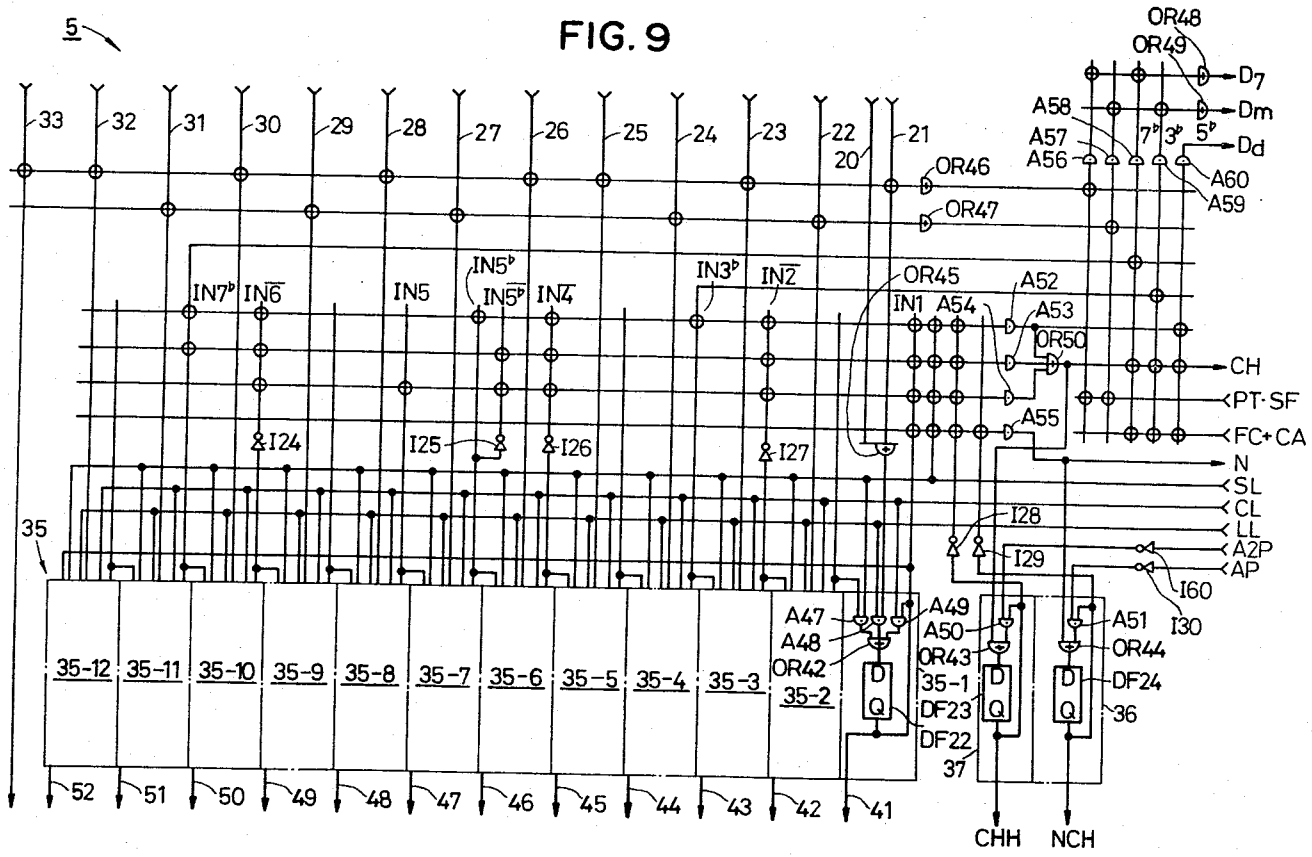

If the finger chord function (FC) or the custom function (CA) which is one mode of the automatic bass chord function is selected, the type of chord constituted by the notes of the depressed keys in the lower keyboard is detected by the note interval relation between these keys. Upon extraction of the block $L_1$ including the key switches in the lower keyboard by the block detection circuit 2 (FIG. 4), a signal L1P of 48 microseconds is applied to the OR gate $OR_{33}$ (FIG. 8). The output of the OR gate $OR_{33}$ is inverted by the inverter $I_{20}$ and applied as the clear signal CL to the note register 35 (FIG. 9) to clear the signals held in the respective stages 35-1 through 35-12. As the block $L_1$ through $L_4$ including the key switches in the lower keyboard is extracted and, in response to this extraction, signals representing the notes of the key switches which are on are outputted from the output lines 21 through 33 of the note detection circuit 4 (FIG. 5), the AND gate $A_{27}$ of the decoder 10 (FIG. 8) is enabled to produce the signal LT. This signal LT is applied as the load signal LL to the note register 35 through the OR gate $OR_{34}$. The note register 35 loads the signals representing the notes of the key switches which are on the lower keyboard appearing successively on the output lines 21 through 32 of the note detection circuit 4 into corresponding ones of the stages 35-1 through 35-12 for storing these signals therein. Since the clear signal CL is generated only during 48 microseconds during which the signal L1P is outputted from the block detection circuit 2, the note register 35 loads all signals for the key switches which are on regardless of the blocks $L_1$ through $L_4$ to which the key switches which are on belong. The outputs of the detection circuit 17-13 detecting the key switch corresponding to the note C on the high tone side is loaded in the stage 35-1 corresponding to the note $C_L$ on the low tone side. That is to say, the output of the detection circuit 17-13 is applied to the AND gate $A_{15}$, The AND gate $A_{15}$ receives at the other input thereof a signal $\overline{FT}$ which is obtained by inverting by an inverter $I_{19}$ through an OR gate $OR_{31}$, the signals $F_1T$ and $F_2T$ outputted by the AND gates $A_{24}$ and $A_{25}$ of the decoder 10, i.e., a signal which is "1" when blocks other than the blocks $F_1$ and $F_2$ including the function switches are being detected. Accordingly, the AND gate $A_{15}$ is enabled during detection of the key switches of the lower keyboard and the output of the detection circuit 17-13 is applied to the load control AND gate $A_{48}$ in the stage 35-1 of the note register 35 via the AND gate $A_{15}$, line 20 and an OR gate $OR_{45}$ (FIG. 9).

In the above described manner, the signals representing the notes of the key switches which are on in the lower keyboard are loaded and stored in corresponding ones of the stages 35-1 through 35-12 in the note register 35. As the extraction of the blocks including the key switches of the lower keyboard has been completed and the signal LT from the AND gate $A_{27}$ (FIG. 8) has disappeared, the load signal LL is turned to "0" and the signals representing the notes of the key switches which are on in the upper keyboard subsequently generated are not loaded in the note register 35.

As the extraction of the blocks including the key switches of the upper keyboard has been completed and the signal $A_1P$ thereupon is outputted from the automatic bass chord processing circuit 15-1, the signal $A_1T$ is outputted from the AND gate $A_{29}$ of the decoder 10 (FIG. 8) with a delay of 48 microseconds. This signal $A_1T$ is applied as the shift signal SL to the shift control AND gate $A_{47}$ of the stages 35-1 through 35-12 of the note register 35. Accordingly, the signal $A_1T$ is applied to the note register 35 as the clear signal CL through the OR gate $OR_{33}$ and the inverter $I_{20}$. The note register 35 therefore successively shifts the signals stored in the respective stages 35-1 through 35-12, i.e., the signals representing the notes of the key switches which are on in the lower keyboard, rightwardly in synchronism with the clock pulse of 48 microseconds. Accordingly, the signal stored in the stage 35-12 has been shifted to the stage 35-1 when $48\times12$ microseconds have elapsed.

In the note register 35, the signals stored in the stages 35-1 through 35-12 are in predetermined note interval relations to the signal stored in the stage 35-1. More specifically the output of the stage 35-1 represents a perfect prime, that of the stage 35-2 a minor second degree, that of the stage 35-3 a major second degree, that of the stage 35-4 a minor third degree, that of the stage 35-5 a minor third degree, that of the stage 35-7 a diminished fifth degree, that of the stage 35-8 a perfect fifth degree, that of the stage 35-9 a minor sixth degree, that of the stage 35-10 a major sixth degree, that of the stage 35-11 a minor seventh degree and the output of the stage 35-12 a major seventh degree.

Accordingly, a type of chord constituted by the notes of the keys depressed in the lower keyboard can be detected from the outputs of the stages 35-1 through 35-12 of the shift register 35 in shifting operation. For detecting the chord are employed a signal $IN_1$ representing a perfect prime note which is the output of the stage 35-1, a signal $IN_{\bar{2}}$ representing absence of a major second degree note and obtained by inverting the output of the stage 35-3 by an inverter $I_{27}$, a signal $IN_{3b}$ representing a m minor third degree note which is the output of the stage 35-4 a signal $IN_{\bar{4}}$ representing absence of a perfect fourth, degree note and obtained by inverting the output of the stage 35-6 by an inverter $I_{26}$, a signal $IN_{\overline{5b}}$ representing absence of a diminished fifth degree note and obtained by inverting the output of the stage 35-7 by an inverter $I_{25}$, a signal $IN_5$ representing a diminshed fifth degree note which is the output of the stage 35-7, a signal $IN_5$ representing a perfect fifth degree note which is the output of the 35-8, a signal $IN_{\bar{6}}$ representing absence of a major sixth degree note and obtained by inverting the output of the stage 35-10 by an inverter $I_{24}$ and a signal $IN_7$ representing a minor seventh degree note which is the output of the stage 35-11. The chord detection is conducted by AND gates $A_{52}$, $A_{53}$, $A_{54}$ and $A_{55}$.

The AND gate $A_{52}$ is provided for detecting a chord consisting of notes of minor seventh degree, diminished fifth degree and minor third degree. Conditions for enabling the AND gate $A_{52}$ is expressed by the following logical formula (1):

$$\overline{CHH}.SL.IN_1.IN_{\bar{2}}.IN_{3b}.IN_{\bar{4}}.\ IN_{5b}.IN_{\bar{6}}.\ IN_{7b} \quad (1)$$

Alternatively stated, the AND gate $A_{52}$ is enabled if the keys for the notes of prime, minor third degree, diminished fifth degree and minor seventh degree are simultaneously depressed while the keys for the notes of major second degree, perfect fourth degree and major sixth degree are not depressed. The signal SL represent the shift signal and a signal $\overline{CHH}$ represents a signal obtained by inverting the output of the chord detection signal memory 37 to be described later by an inverter $I_{28}$ and representing that a chord has not been detected yet.

The AND gate $A_{53}$ is provided for detecting a chord including a minor seventh degree note (i.e., seventh chord or minor seventh chord). Conditions for enabling the AND gate $A_{53}$ is expressed by the following logical formula (2):

$$\overline{CHH}.SL.IN_1.IN_{\bar{2}}.IN_{\bar{4}}.INH_{\overline{5b}}.IN_{\bar{6}}.IN_{\overline{7b}} \quad (2)$$

That is, the AND gate $A_{53}$ is enabled if the keys for the notes of prime and minor seventh degree are simultaneously depressed while the keys for the notes of major second degree, perfect fourth degree, diminished fifth degree and major sixth degree are not depressed.

The AND gate $A_{54}$ is provided for detecting a chord including the perfect fifth degree note (major chord or minor chord). Conditions for enabling the AND gate $A_{54}$ are expressed by the following logical formula (3):

$$\overline{CHH}.SL.IN_1.IN_{\bar{2}}.IN_{\bar{4}}.IN_{\overline{5b}}.IN_5.IN_{\bar{6}} \quad (3)$$

That is, the AND gate $A_{54}$ is enabled if the keys for the note of prime and perfect fifth degree are simultaneously depressed while the keys for the notes of major second degree, perfect fourth degree, diminished fifth degree and major sixth degree are not depressed.

If either one of the above logical formulas (1), (2) and (3) is satisified during shifting of the note register 35, the OR gate $OR_{56}$ to which the outputs of the AND gates $A_{52}$, $A_{53}$ and $A_{54}$ are applied produces a chord detection signal CH with a pulse width of 48 microseconds.

The chord detection signal CH is applied to AND gates $A_{58}$, $A_{59}$ and $A_{60}$ to enable these AND gates. The AND gates $A_{58}$, $A_{59}$ and $A_{60}$ thereupon produce signals *7b*, *3b* and *5b* representing the type of chord. If the signal $IN_{7b}$ representing a minor seventh degree note is produced by the stage 35-11 when the chord detection signal CH is outputted, the AND gate $A_{58}$ is enabled and an OR gate $OR_{48}$ thereby produces a seventh detection signal $D_7$ representing a chord including a minor seventh degree note (i.e. seventh chord). If the signal $IN_3$ representing a minor third degree note if produced by the stage 35-4 when the chord detection signal CH is outputted, the AND gate $A_{59}$ is enabled and an OR gate $OR_{49}$ thereby produces a minor detection signal Dm representing a chord including a minor third degree note (monor chord). If a signal is produced by the AND gate $A_{52}$ when the chord detection signal CH is outputted, the AND gate $A_{60}$ is enabled to produce a diminishment detection signal Dd representing a chord including notes of minor seventh degree, diminished fifth degree and minor third degree (diminishment chord).

The chord detection signal CH is applied to the chord detection signal memory 37. The chord detection sig signal memory 37 applies this signal to a delay flip-flop $DF_{23}$ through an OR gate $OR_{43}$ and temporarily stores this signal by feeding it back to the input of the delay flip-flop $DF_{23}$ through an AND gate $A_{50}$ and the OR gate $OR_{43}$. The output of the chord detection signal memory 37 is inverted by the inverter $I_{28}$ and thereafter is applied to the AND gate $A_{52}$ through the AND gate $A_{54}$. This arrangement is made so that once any one of the logical formulas (1), (2) and (3) has been satisfied and the chord detection signal CH has been outputted during shifting of the note register 35, the AND gates A52 through $A_{54}$ are disabled and outputting of the chord detection signal CH is prohibited even if any one of the logical formulas (1), (2) and (3) is satisfied again. In short, a chord first detected is given priority and no chord detection is made thereafter.

The AND gate $A_{55}$ is provided for generating a non-chord signal used in a case where no chord is formed. Conditions for enabling the AND gate $A_{55}$ are expressed by the following logical formula (4):

$$\overline{NCH}.\overline{CHH}.SL.IN_1 \quad (4)$$

The signal $\overline{CHH}$ is a signal obtained by inverting the output of the non-chord signal memory 36 by an inverter $I_{29}$ and representing that the non-chord signal N has not been generated yet.

Accordingly, the AND gate $A_{55}$ is enabled to produce the non-chord signal N when the signal $IN_1$ is first outputted from the stage 35-1 of the note register 35 by the shifting operation of the note register 35. This signal NC is applied to the non-chord signal memory 36. Upon receipt of the non-chord signal N, the non-chord signal memory 36 temporarily stores this signal by applying this signal to a delay flip-flop $DF_{24}$ through an OR gate $OR_{44}$ and feeding back the output of the delay flip-flop $DF_{24}$ to the input thereof through an AND gate $A_{51}$ and the OR gate $OR_{44}$. The output NCH of the non-chord signal memory is inverted by the inverter $I_{29}$ and thereafter is applied to the AND gate $A_{55}$. The AND gate $A_{55}$ also receives a signal obtained by inverting the output CHH of the note detection memory 37 by the inverter $I_{28}$. In other words, the non-chord signal N first outputted only is given priority.

The chord detection signal CH and the non-chord detection signal N are used for detecting a root note to be described later. However, the non-chord signal N is not used in a case where the finger chord function or the custom function has been selected and used only in a case where the single finger function has been selected.

Upon completion of one cycle of the shifting operation of the note register 35 by shifting of a signal from the stage 35-12 to the stage 35-1, a signal $A_{2p}$ is outputted from the automatic bass chord processing circuit 15-2 of the block detection circuit 2. The signal $A_{2p}$ is inverted by an inverter $I_{60}$ (FIG. 9) and thereafter is applied to the AND gate $A_{50}$ of the chord detection signal memory 37 to clear the storage of the chord detection signal memory 37. The signal $A_{2p}$ is also used as the automatic bass chord control signal AP through the OR gate $OR_{15}$ (FIG. 4). This signal AP is inverted by an inverter $I_{30}$ and applied to the AND gate $A_{51}$ of the non-chord signal memory 36 to clear the storage of the non-chord signal memory 36.

As the signal $A_{2p}$ is produced by the automatic bass chord processing circuit 15-2, the AND gate $A_{30}$ of the decoder 10 (FIG. 8) produces a signal $A_{27}$. This signal $A_{27}$ is applied as the shift signal SL to the note register 35 through the OR gate $OR_{32}$. Accordingly, signals stored in the stages 35-1 through 35-12 of the note register 35 are shifted rightwardly again. This causes the chord detection signal CH and the non-chord signal N to be generated in the same manner as has previously been described. In this case, the chord detection sigal CH is not used but the non-chord signal N only is used for detecting a root note if no chord has been detected in the finger chord function or custom function mode.

DETECTION OF A ROOT NOTE

Figure 14:
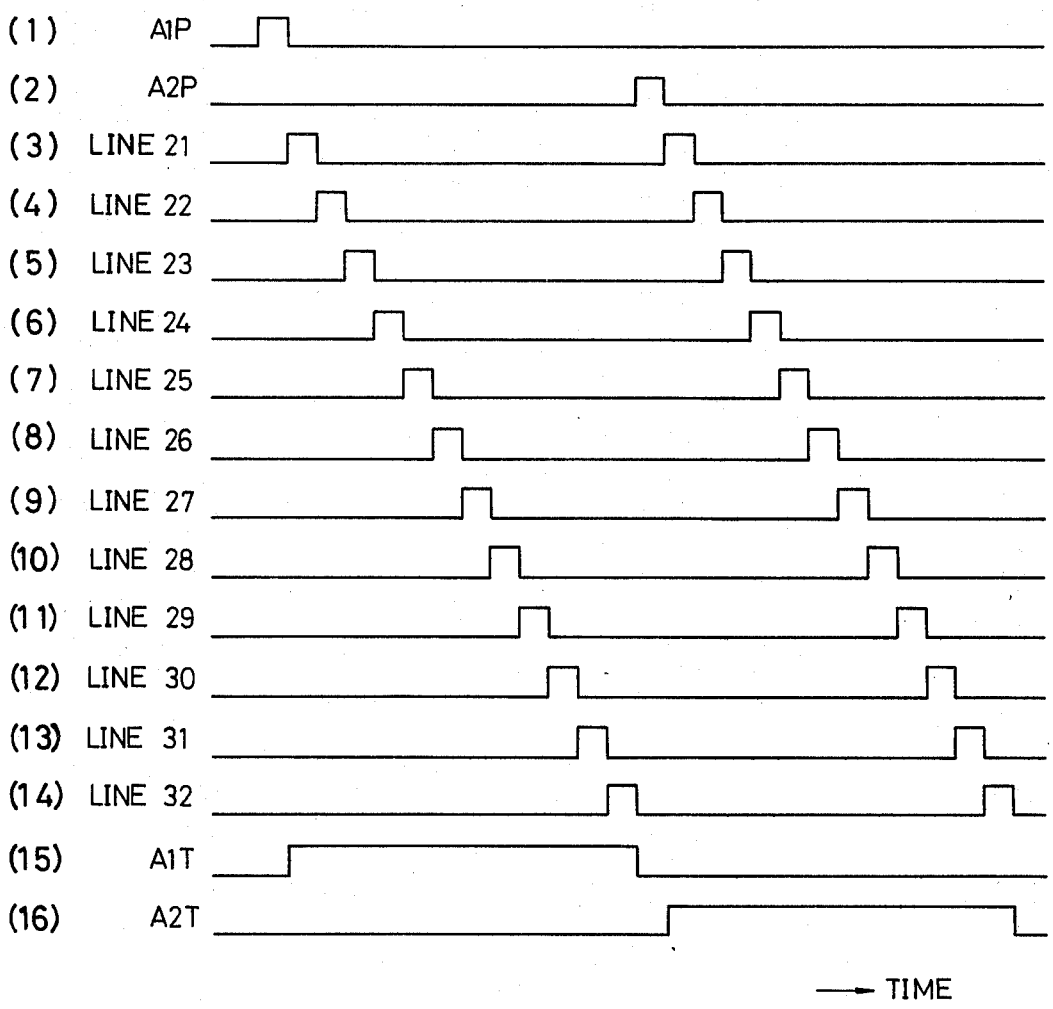
FIG. 14 is a time chart for explaining the operation of the chord detection circuit.

If the finger chord function has been selected, detection of the root note is conducted by using the chord detection signal CH or the non-chord detection signal N. If the signal $A_{1p}$ is outputted from the automatic bass chord processing circuit 15-1 of the block detection circuit 2 (FIG. 4), this signal $A_{1p}$ is applied as a the signal AP to the OR gate $OR_{16}$ of the detection circuit 17-1 through 17-12 of the note detection circuit 4 (FIG. 5) through the OR gate $OR_{15}$. Signals representing respective notes are thereby provided on output lines 21 through 32 of the detection circuit 17-1 through 17-12 (FIG. 14 (3)-(14)). At this time, the shift signal SL is applied to the note register 35 thereby to cuccessively shift the signals stored in the respective stages 35-1 through 35-12 rightwardly. The signals are generated every 48 microseconds from the detection circuits 17-1 through 17-12 while shifting of the note register 35 is conducted ever 48 microseconds so that generation of the signals from the detection circuits is synchronized with shifting of the note register 35. If, for example, a signal representing the note C♯ stored in the state 35-2 is first shifted to the stage 35-1 and the signal $IN_1$ is outputted from the stage 35-1, a signal representing the note C♯ is outputted from the output line 22 of the detection circuit 17-2 of the note detection circuit 4 in synchronization with this shifting of the signal representing the note C♯. If the signal representing the note E stored in the stage 35-5 is shifted to the stage 35-1 and the signal $IN_1$ is outputted from the stage 35-1, a signal representing the note E is outputted from the output line 25 of the note detection circuit 4 in synchronization with the shifting of the signal representing the note E. Accordingly, by detecting the signal outputted from the note detection circuit 2 at the time when a chord has been detected, this signal represents a prime note, i.e., the root note.

If the output of the note register 35 satisfies either one of the logical formulas (1), (2) and (3) and an OR gate $OR_{50}$ produces the chord detection signal CH, this signal is applied to an AND gate $A_{37}$ of the control signal forming circuit 11 (FIG. 8). The AND gate $A_{37}$ has received at the other inputs thereof the signal FC indicating that the finger chord function has been selected and the signal $A_1T$ (FIG. 14(15)) indicating that the automatic bass chord processing circuit 15-1 is in a processing mode. Accordingly, the AND gate $A_{37}$ is enabled and produces a signal "1" upon receipt of the chord detection signal CH and this signal "1" is applied as a root note load signal LKN to AND gates $A_{78}$ of the key code registers 9-1 through 9-4 (FIG. 11) through an OR gate $OR_{38}$. This enables the AND gates $A_{78}$ to apply the note code $NC_1$-$NC_4$ outputted at this time from the encoder 34 of the note detection circuit 4 to delay flip-flops $DF_{37}$ through OR gates $OR_{61}$ as the root note. The outputs of the delay flip-flops $DF_{37}$ are fed back to the inputs thereof through AND gates $A_{79}$ and OR gates $OR_{61}$ so that the note code $NC_1$-$NC_4$ representing the root note is held in the delay flip-flops $DF_{37}$. The AND gates $A_{79}$ receive at the other inputs thereof signals obtained by inverting the root note load signal LKN by inverters $I_{41}$ so as to clear the previously stored signal representing the root note upon receipt of the root note load signal LKN.

The output of the AND gate $A_{37}$ (FIG. 8) is applied to the memory 39 through an OR gate $OR_{39}$. The memory 39 applies the signal thus supplied to a delay flip-flop 35 through an OR gate $OR_{60}$ and feeds back the output of the delay flip-flop 35 to the input thereof through an AND gate $A_{76}$ and the OR gate $OR_{60}$ thereby storing the applied signal.

If none of the logical formulas (1), (2) and (3) is satisfied in the shifting operation of the note register 35, the chord detection signal CH is not generated and, accordingly, the root note cannot be detected. In this case, a note represented by a signal stored in the rightmost stage among the signals stored in the note register 35 i.e., a signal for the lowest note, is made the root note. Detection of the root note in this case is conducted by utilizing the non-chord signal NC which is detected during shifting of the note register 35 performed again in response to the output $A_{2p}$ of the automatic bass chord processing circuit 152 (FIG. 14(2)). As the signal stored in the rightmost stage of the note register 35 is shifted to the stage 35-1, the AND gate $A_{55}$ is enabled to produce the non-chord signal N. At this time, the note detection circuit 4 produces a signal representing the note of the signal stored in the rightmost stage.

The non-chord signal N is applied to an AND gate 36 (FIG. 8). The AND gate 36 receives at the other inputs thereof a signal obtained by inverting the output of the memory 39 by an inverter $I_{21}$, i.e., a sinal indicating that a chord has not been formed and the signal $A_{2T}$ (FIG. 14(16)) produced in accordance with the signal FC selecting the finger chord function and the output $A_{2p}$ of the automatic bass chord processing circuit 15-2. Accordingly, the AND gate $A_{36}$ is enabled to produce a signal "1". This signal "1" is applied as the root note load signal LKN to the key code registers 9-1 through 9-4 (FIG. 11) through the OR gate $OR_{38}$. The key code $NC_1$-$NC_4$ produced at this time by the encoder 34 of the note detection circuit 4 is the signal representing the root note.

If the signal finger function has been selected, a note of a key depressed in the lower keyboard is made a root note. Detection of a root note in this case is made by using the non-chord signal N. In the case of the single finger function, a single key is depressed in the lower keyboard. Wehn a signal representing the note of this key has been shifted to the stage 35-1 in shifting of the note register 35, the non-chord signal N is generated. This non-chord signal N is applied to an AND gate $A_{38}$ (FIG. 8). The AND gate $A_{38}$ receives at the other input thereof the signal SF used for selecting the single finger function and the signal $A_{1T}$ produced in response to the output signal $A_{1p}$ of the automatic bass chord processing circuit 15-1. Accordingly, the AND gate $A_{38}$ is enabled to produce a signal "1". This signal "1" is applied to the key code registers 9-1 through 9-4 (FIG. 11) as the root note load signal LKN via the OR gate $OR_{38}$. The key code register 9-1 through 9-4 thereby load the note code $NC_1$-$NC_4$ produced at this time from the encoder 34 of the note detection circuit 4 as a signal representing the root note.

If the custom function has been selected, a note of a key depressed in the pedal keyboard is used as a root note. As the block P including the key switches of the pedal keyboard has been extracted by the block detection circuit 2 and the signal PT has been outputted by the AND gate $A_{26}$ (FIG. 8) of the decoder 10, this signal PT is applied to the AND gate $A_{35}$. The AND gate $A_{35}$ receives at the other input thereof the signal AC used for selecting the custom fucntion CA and a signal TTP which maintains a state "1" during the last 48 microseconds of the state $S_3$. The AND gate $A_{35}$ therefore is enabled when a signal representing the note of the key depressed in the pedal keyboard is outputted by the note detection circuit 4 and produces a signal "1". This signal "1" is applied to the key code registers 9-1 through 9-4 (FIG. 11) as the root note load signal LKN via the OR gate $OR_{38}$ for causing the note code $NC_1$-$NC_4$ being produced by the encoder 34 of the note detection circuit 4 to be loaded as a signal representing the root note.

GENERATION OF KEY CODE DATA IN CASE WHERE THE FINGER CHORD FUNCTION HAS BEEN SELECTED

If the finger chord function has been selected, the automatic chord performance and the automatic bass performance are conducted in accordance with plural notes of keys depressed in the lower keyboard. Key code data indicating chord notes for conducting the automatic chord performance is produced in accordance with signals from key switches for keys actually depressed in the lower keyboard. Key code data indicating bass notes for conducting the automatic bass performance is produced in accordance with the note code $NC_1$–$NC_4$ and the octave code $OC_1$, $OC_2$ representing the root note loaded in the key code registers 9-1 through 9-4 (FIG. 11) and the signal $D_7$, $D_m$ and $D_d$ representing the chord type produced by the code detection circuit (FIG. 9).

If notes of keys depressed in the lower keyboard have formed a desired chord, the chord detection circuit 5 produces the chord detection signal CH and, in response hereto, the AND gate $A_{37}$ of the control signal forming circuit 11 (FIG. 8) is enabled to cause the root note load signal LKN to be produced from the OR gate $OR_{38}$. This root note load signal LKN is applied to the key code register 9-1 through 9-4 and also to a delay flip-flop $DF_{32}$ through an OR gate $OR_{57}$. The signal applied to the delay flip-flop $DF_{32}$ is delayed by 48 microseconds and thereafter is applied to an AND gate $A_{85}$ (FIG. 11) as a data selection signal AKD used for the automatic bass chord performance. The AND gate $A_{85}$ receives at the other input thereof a signal $T_B$ outputted by an OR gate $OR_{88}$ which receives signals $T_1$, $T_2$, $T_4$ and $T_8$ representing a bass pattern from a shift register 54 (FIG. 12) to be described later and the signal CON from the function data memory 6-5 (FIG. 10) indicating that a constant function has been selected. Accordingly, the AND gate $A_{85}$ is enabled either when the bass pattern $T_1$, $T_2$, $T_4$ and $T_8$ is produced or when the constant function has been selected. The AND gate $A_{85}$ thereupon produces a signal "1" and supplies it to AND gates $A_{81}$, $A_{82}$, $A_{83}$ and $A_{84}$ through an OR gate $OR_{64}$ to enable the AND gates $A_{81}$ through $A_{84}$.

The AND gates $A_{81}$ through $A_{84}$ receive at the other input thereof the outputs of the key code registers 9-1 through 9-4. Accordingly, the note code $NC_1$–$NC_4$ representing the root not loaded in the key code registers 9-1 through 9-4 is applied to the inputs A of the adders 12-1 through 12-4 through the AND gates $A_{81}$ through $A_{84}$ and OR gates $OR_{65}$ through $OR_{68}$. At this time, the output AKD-TB of the AND gata $A_{85}$ is applied to an OR gate $OR_{29}$ shown in FIG. 8 to cause the delay flip-flop DF17 to output the signal P representing a bass tone (i.e. a tone of a key in the pedal keyboard.

Figure 12:
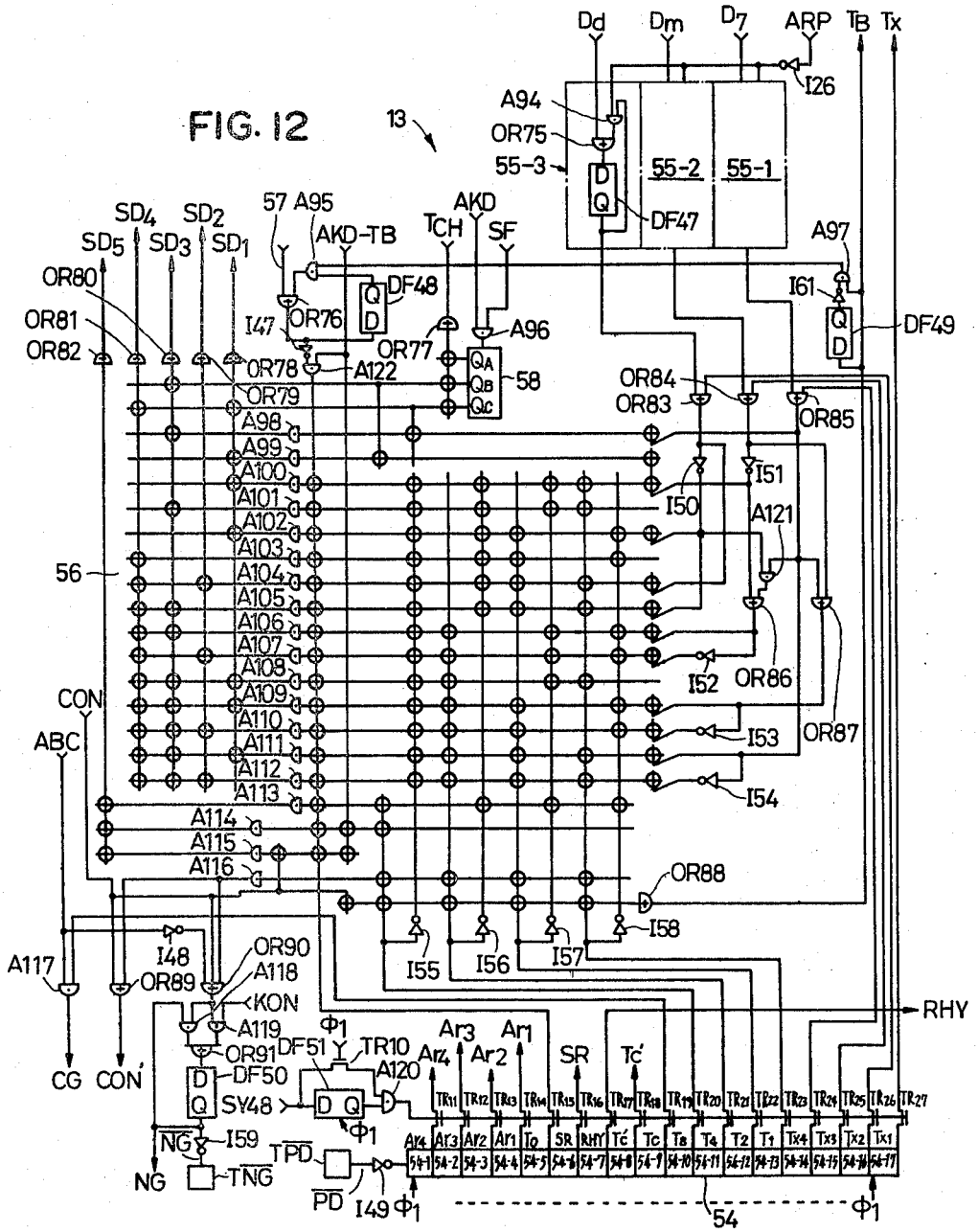

To the inputs B of the adders 12-1 through 12-4 is applied subordinate note forming data $SD_1$–$SD_4$. This subordinate note forming data $SD_1$–$SD_4$ representing a predetermined note interval relation to the root note is generated by the subordinate note data generation circuit 13 (FIG. 12).

Control data indicating a timing associated with each of various rhythm patterns read from a control data memory (not shown) in response to the function data transmitted from the function data transmission circuit 7 (FIG. 10) is applied in the form of an inverted serial signal $\overline{PD}$ to a terminal $T_{PD}$. This signal $\overline{PD}$ is inverted by an inverter $I_{49}$ and the inverted signal PD is used to load various control data in stages 54-1 through 54-17 of the shift register 54. Control data to be loaded in the stages 54-14 through 54-17 is a circuit testing signal $T_{X3}$, $T_{x2}$, $T_{x1}$, $T_{x0}$, that to be loaded in the stages 54-10 through 54-13 is a 4-bit signal $T_8$, $T_4$, $T_2$, $T_1$, that to be loaded in the stages 54-8 and 54-9 is chord timing signals Tc' and Tc indicating tone production timing of chord tones, the signal Tc' representing a signal of a long duration used for the rhythm of rhumba. Control data to be loaded in the stage 54-7 is a rhythm-on signal RHY representing that the automatic rhythm performance device (not shown) is in operation, that to be loaded in the stage 54-6 is a slow rock signal SR, that to be loaded in the stages 54-1 through 54-4 is a signal $A_{r4}$, $A_{r3}$, $A_{r2}$, $A_{r1}$ representing an arpeggio pattern. Since the arpeggio pattern signal $A_{r4}$, $A_{r3}$, $A_{r2}$, $A_{r1}$, the slow rock signal SR and the chord timing signal Tc' are used for the automatic arpeggio performance device provided in the channel processor (not shown) and not used in the illustrated circuits, detailed description of these signals will be omitted.

The outputs of the respective stages of the shift register 54 are applied to transistors $TR_{11}$ through $TR_{27}$. The transistors $TR_{11}$ through $TR_{27}$ are gate controlled by the output of an AND gate $A_{120}$ which receives a signal obtained by delaying the synchronizing signal $SY_{48}$ by a delay flip-flop $DF_{51}$ by 1 microsecond and a signal obtained by gating the synchronizing signal $SY_{48}$ by a transistor 10 with a pulse $\phi_1$ having a pulse width of 1 microsecond. Accordingly, the transistors $TR_{11}$ through $TR_{27}$ are turned on during a first 1 microsecond of the clock pulse $\phi$ and gate out the signal loaded in the respective slages of shift register 54 as signals with a pulse width of 1 microsecond. This state is held after the output of the AND gate $A_{120}$ is changed to "0".

The seventh detection signal $D_7$, minor detection signal $D_m$ and diminishment detection signal Dd generated by the chord detection circuit 5 (FIG. 9) are applied to chord memories 55-1, 55-2 and 55-3. As representably illustrated by the chord memory 55-3, each of the chord memories 55-1 through 55-3 stores the signal applied thereto by supplying it to a delay flip-flop $DF_{47}$ through an OR gate $OR_{75}$ and feeding back the output of the delay flip-flop $DF_{47}$ to the input thereof through an AND gate $A_{94}$ and an OR gate $OR_{75}$. To the other input of the AND gate $A_{94}$ is applied a signal obtained by inverting the output ARP of the automatic arpeggio processing circuit 16 of the block detection circuit 2 by an inverter $I_{49}$ so that the signals stored in the chord memories 55-1 through 55-3 are cleared each time the signal ARP is outputted from the automatic arpeggio processing circuit 16.

The subordinate note forming data $SD_1$–$SD_4$ is generated in response to the signal $T_1$, $T_2$, $T_3$, $T_4$ indicating the bass pattern read from the shift register 54. The signal $T_1$–$T_8$ is a 4-bit code signal designating a note interval of a subordinate note relative to the root note.

As the bass pattern signal $T_1$–$T_8$ is generated, this signal $T_1$–$T_8$ is applied to an AND gate $A_{97}$ as the signal $T_B$ via an OR gate $OR_{88}$. This signal $T_B$ is delayed by a delay flip-flop $DF_{49}$ by 48 microseconds and applied to the other input of the AND gate $A_{97}$ after being inverted by an inverter $I_{61}$. Accordingly, the AND gate $A_{97}$ produces a signal "1" with a width of a 48 microseconds only when the signal $T_B$ has first been produced. This signal "1" is applied to an AND gate $A_{122}$ through an AND gate $A_{95}$, OR gate $OR_{76}$ and inverter $I_{47}$. To the other input of the AND gate $A_{122}$ is applied the output signal AKD. $T_B$ of the AND gate $A_{85}$. Accordingly, the AND gate $A_{122}$ is enabled and supplies a signal "1" to AND gates $A_{100}$ through $A_{113}$ to enable them.

The bass pattern signal $T_1$, $T_2$, $T_4$, $T_8$ or a signal obtained by inverting the signal $T_1$, $T_2$, $T_4$, $T_8$ by inverters $I_{58}$, $I_{57}$, $I_{56}$ and $I_{55}$ is applied to the AND gates $A_{100}$ through $A_{113}$. Signals produced in response to the signals $D_7$, $D_m$ and $D_d$ representing the type of a detected chord stored in the chord memories 55-1 through 55-3 are also applied to the AND gates $A_{100}$ through $A_{113}$. Accordingly, one or more of the AND gates $A_{100}$ through $A_{113}$ are enabled and produce a signal "1" in accordance with the bass pattern signal $T_1$, $T_2$, $T_4$, $T_8$ and the signals $D_7$, $D_m$ and $D_d$ stored in the chord memories 55-1 thorugh 55-3.

If for example, the type of the detected chord is the seventh chord including the minor seventh degree note and the seventh detection signal $D_7$ is stored in the chord memory 55-1 while no signal is stored in the chord memories 55-2 and 55-3 and if the bass pattern signal $T_1$, $T_2$, $T_4$, $T_8$ is "1000", the AND gate $A_{100}$ which receives a signal "1" produced by inverting a signal "0" supplied from the chord memory 55-2 through an OR gate $OR_{84}$ and the AND gate $A_{101}$ which receives only the bass pattern signal $T_1$, $T_2$, $T_4$, $T_8$ are simultaneously enabled. If the bass pattern signal $T_1$, $T_2$, $T_4$, $T_8$ is "0100", the AND gate $A_{102}$ which receives a signal produced by inverting a signal "0" supplied from the chord meory 55-3 through the OR gate $OR_{83}$ by an inverter $I_{50}$ and the AND gate $A_{103}$ which receives only the bass pattern signal $T_1$, $T_2$, $T_4$, $T_8$ are simultaneously enabled. If the bass pattern signal $T_1$, $T_2$, $T_4$, $T_8$ is "1100", the AND gate $A_{105}$ which receives the output of the inverter $I_{50}$ is enabled. If the bass pattern signal $T_1$, $T_2$, $T_4$, $T_8$ is "0010", the AND gate $A_{106}$ which receives, through an OR gate $OR_{86}$ the output of an inverter $I_{50}$ or the output of an AND gate 121 which is enabled by the output of an inverter $I_{50}$ and the output of the chord memory 55-1 supplied through an OR gate $OR_{85}$ is enabled. If the bass pattern signal $T_1$, $T_2$, $T_3$, $T_4$ is "1010", the AND gate $A_{108}$ which receives only the bass pattern signal is enabled. If the bass pattern signal $T_1$, $T_2$, $T_3$, $T_4$ is "0110", the AND gate $A_{109}$ which receives the output of the OR gate $OR_{85}$ through an OR gate $OR_{87}$ is enabled. If the bass pattern signal $T_1$, $T_2$, $T_4$, $T_8$ is "1110", the AND gate $A_{111}$ which receives the output of the OR gate $OR_{85}$ is enabled. If the bass pattern signal $T_1$, $T_2$, $T_4$, $T_8$ is "0001", the AND gate 113 which receives the bass pattern signal only is enabled.

The outputs of the AND gates $A_{100}$ through $A_{113}$ are applied to an encoder 56 consisting of OR gates $OR_{78}$ through $OR_{82}$. The encoder 56 produces the subordinate note forming data $SD_1$–$SD_4$ in accordance with the outputs of the AND gate $A_{100}$ through $A_{113}$.

The following Tables 7, 8, 9 and 10 show relations between the bass pattern signal $T_1$, $T_2$, $T_4$, $T_8$ and the subordinate note forming data $SD_1$–$SD_5$ generated in response to the bass pattern signal in cases where no signal is stored in any of the chord memories 55-1 through 55-3, i.e., the detected chord is the major chord, where the seventh chord is detected by existence of the seventh detection signal $D_7$ in the chord memory 55-1 only, where the minor chord is detected by existence of the minor chord is detected by existence of the minor detection signal Dm in the chord memory 55-2 only, and where the diminishment detection signal Dd is stored in the chord memory 55-3 and the seventh detection signal $D_7$ and the minor detection signal Dm are stored in the chord memories 55-1 and 55-2.

TABLE 7

| The case where the major chord has been detected. | | | | | | | | |
|---|---|---|---|---|---|---|---|---|
| $T_8$ | $T_4$ | $T_2$ | $T_1$ | $SD_5$ | $SD_4$ | $SD_3$ | $SD_2$ | $SD_1$ |
| 0 | 0 | 0 | 0 | | 0 | 0 | 0 | 0 |
| 0 | 0 | 0 | 1 | | 0 | 1 | 0 | 1 |
| 0 | 0 | 1 | 0 | | 1 | 0 | 0 | 1 |
| 0 | 0 | 1 | 1 | | 1 | 1 | 0 | 0 |
| 0 | 1 | 0 | 0 | | 1 | 0 | 1 | 0 |
| 0 | 1 | 0 | 1 | | 1 | 1 | 0 | 1 |
| 0 | 1 | 1 | 0 | | 1 | 1 | 1 | 0 |
| 0 | 1 | 1 | 1 | | 1 | 1 | 1 | 0 |
| 1 | 0 | 0 | 0 | 1 | 0 | 0 | 0 | 0 |

TABLE 8

| The case where the major chord has been detected | | | | | | | | |
|---|---|---|---|---|---|---|---|---|
| $T_8$ | $T_4$ | $T_2$ | $T_1$ | $SD_5$ | $SD_4$ | $SD_3$ | $SD_2$ | $SD_1$ |
| 0 | 0 | 0 | 0 | | 0 | 0 | 0 | 0 |
| 0 | 0 | 0 | 1 | | 0 | 1 | 0 | 1 |
| 0 | 0 | 1 | 0 | | 1 | 0 | 0 | 1 |
| 0 | 0 | 1 | 1 | | 1 | 1 | 0 | 0 |
| 0 | 1 | 0 | 0 | | 1 | 1 | 0 | 0 |
| 0 | 1 | 0 | 1 | | 1 | 1 | 0 | 1 |
| 0 | 1 | 1 | 0 | | 1 | 1 | 0 | 1 |
| 0 | 1 | 1 | 1 | | 1 | 1 | 0 | 1 |
| 1 | 0 | 0 | 0 | 1 | 0 | 0 | 0 | 0 |

TABLE 9

| The case where the minor chord has been detected | | | | | | | | |
|---|---|---|---|---|---|---|---|---|
| $T_8$ | $T_4$ | $T_2$ | $T_1$ | $SD_5$ | $SD_4$ | $SD_3$ | $SD_2$ | $SD_1$ |
| 0 | 0 | 0 | 0 | | 0 | 0 | 0 | 0 |
| 0 | 0 | 0 | 1 | | 0 | 1 | 0 | 1 |
| 0 | 0 | 1 | 0 | | 1 | 0 | 0 | 1 |
| 0 | 0 | 1 | 1 | | 1 | 1 | 0 | 0 |
| 0 | 1 | 0 | 0 | | 1 | 0 | 1 | 0 |
| 0 | 1 | 0 | 1 | | 1 | 1 | 0 | 1 |
| 0 | 1 | 1 | 0 | | 1 | 1 | 1 | 0 |
| 0 | 1 | 1 | 1 | | 1 | 1 | 1 | 0 |
| 1 | 0 | 0 | 0 | 1 | 0 | 0 | 0 | 0 |

TABLE 10

| The case where the diminishment chord has been detected | | | | | | | | |
|---|---|---|---|---|---|---|---|---|
| $T_8$ | $T_4$ | $T_2$ | $T_1$ | $SD_5$ | $SD_4$ | $SD_3$ | $SD_2$ | $SD_1$ |
| 0 | 0 | 0 | 0 | | 0 | 0 | 0 | 0 |
| 0 | 0 | 0 | 1 | | 0 | 1 | 0 | 0 |
| 0 | 0 | 1 | 0 | | 1 | 0 | 0 | 1 |
| 0 | 0 | 1 | 1 | | 1 | 1 | 0 | 0 |
| 0 | 1 | 0 | 0 | | 1 | 0 | 1 | 0 |
| 0 | 1 | 0 | 1 | | 1 | 1 | 0 | 1 |
| 0 | 1 | 1 | 0 | | 1 | 1 | 0 | 1 |
| 0 | 1 | 1 | 1 | | 1 | 1 | 1 | 0 |
| 1 | 0 | 0 | 0 | 1 | 0 | 0 | 0 | 0 |

The signals $SD_1$ through $SD_4$ among the subordinate note forming data $SD_1$–$SD_5$ generated by the subordinate note forming data generation circuit 13 are applied to the inputs B of the adders 12-1 through 12-4 (FIG. 11). The subordinate note forming data $SD_1$–$SD_4$ represents, as has previously been described, a predetermined note interval and relations between various note intervals and the subordinate note forming data $SD_1$–$SD_4$ are shown in the following Table 11. It should be noted, however, that signals representing prime, major second, major third and perfect fourth among the subordinate note forming data shown in Table 11 are not used in the present embodiment of the invention.

TABLE 11

| | Subordinate note forming data | | | |
|---|---|---|---|---|
| Note interval | $SD_4$ | $SD_3$ | $SD_2$ | $SD_1$ |
| Prime (1) | 0 | 0 | 0 | 0 |
| Minor second (2♭) | 0 | 0 | 0 | 1 |
| Major second (2) | 0 | 0 | 1 | 0 |
| Minor third (3♭) | 0 | 1 | 0 | 0 |
| Major third (3) | 0 | 1 | 0 | 1 |
| Perfect fourth (4) | 0 | 1 | 1 | 0 |
| Diminished fifth (5♭) | 1 | 0 | 0 | 0 |
| Perfect fifth (5) | 1 | 0 | 0 | 1 |
| Minor sixth (6♭) | 1 | 0 | 1 | 0 |
| Major sixth (6) | 1 | 1 | 0 | 0 |
| Minor seventh (7♭) | 1 | 1 | 0 | 1 |
| Major seventh (7) | 1 | 1 | 1 | 0 |

The adders 12-1 through 12-4 add the note code $NC_1$–$NC_4$ representing the root note applied to the inputs A with the subordinate note forming data $SD_1$–$SD_4$ applied to the inputs B to form a signal indicating a note name of a desired subordinate note.

Values of the note code $NC_1$–$NC_4$ representing the root note do not assume continuously increasing values as will be understood from Table 5. With reference to Table 5, a code "0000" is missing before the note code "0001" representing the note C#, a code "0100" is missing between the note code "0011" representing the note D# and the note code "0101" representing the note E, a code "1000" is missing between the note code "0111" representing the note F# and the note code "1001" representing the note G and a code "1100" is missing between the note code "1011" representing the note A and the note code "1101" representing the note A#. The code "1100" among these missing codes is used as a note code representing the note $C_L$ on the lower tone side. Accordingly, contents of the note code $NC_1$–$NC_4$ are rewritten as the following Table 12.

TABLE 12

| | Note code | | | |
|---|---|---|---|---|
| Note | $NC_4$ | $NC_3$ | $NC_2$ | $NC_1$ |
| C# | 0 | 0 | 0 | 1 |
| D | 0 | 0 | 1 | 0 |

TABLE 12-continued

| Note | Note code | | | |
|---|---|---|---|---|
| | $NC_4$ | $NC_3$ | $NC_2$ | $NC_1$ |
| D# | 0 | 0 | 1 | 1 |
| E | 0 | 1 | 0 | 1 |
| F | 0 | 1 | 1 | 0 |
| F# | 0 | 1 | 1 | 1 |
| G | 1 | 0 | 0 | 1 |
| G# | 1 | 0 | 1 | 0 |
| A | 1 | 0 | 1 | 1 |
| A# | 1 | 1 | 0 | 1 |
| B | 1 | 1 | 1 | 0 |
| C | 1 | 1 | 1 | 1 |

The values of the note code $NC_1$–$NC_4$ are determined in the manner shown in Table 12 so that the subordinate notes may be easily formed by using the 4-bit note code $NC_1$–$NC_4$ in the form of a circulating signal. If, however, a result of addition of the note code $NC_1$–$NC_4$ and the subordinate note forming data $SD_1$–$SD_4$ becomes a code "0000", "0100", "1000" or "1100" which is not used for the note code, a subordinate note cannot be formed. Accordingly, values of 2 bits $NC_1$ and $NC_2$ counting from the least significant bit are suitably corrected in accordance with the first bit signal $SD_1$ or the second bit signal $SD_2$ of the subordinate note forming data.

This correction of values is made by using the AND gates $A_{86}$, $A_{87}$ and $A_{88}$. The AND gate $A_{86}$ receives the first bit signal $SD_1$ of the subordinate note forming data, the first bit $NC_1$ of the note code $NC_1$–$NC_4$ and the second bit $NC_2$ of the note code $NC_1$–$NC_4$ which is the output of the OR gate $OR_{72}$. The AND gate $A_{87}$ receives the second bit signal $SD_2$ of the subordinate note forming data, the output signal $NC_1$ of OR gate $OR_{65}$ and the output signal $NC_2$ of the OR gate $OR_{72}$. The AND gate $A_{88}$ receives the second bit signal $SD_2$ of the subordinate note forming data and a signal produced by inverting the first bit $NC_1$ of the note code $NC_1$–$NC_4$ which is the output of the OR gate $OR_{71}$ by an inverter $I_{45}$ and the output signal $NC_2$ of the OR gate $OR_{72}$. Accordingly, if either one of logical formulas $$NC_1.NC_2.SD_1 \quad (5)$$

$$NC_1.NC_2.SD_2 \quad (6)$$

$$NC_1.NC_2.SD_3 \quad (7)$$

is satisfied, a signal "1" is applied to a carry input Ci of the adder 12-1 through an OR gate $OR_{70}$ to add "1" to the contents of the adder 12-1.

If, for example, the note code $NC_4$–$NC_1$ "0011" representing the note D and the subordinate note forming data "0101" representing the major third degree are added together, a value "1000" is obtained and this value "1000" is note used as the note code $NC_4$–$NC_1$. At this time, however, the AND gate $A_{86}$ is enabled to add "1" to the result of addition "1000" thereby producing a note code $NC_4$–$NC_1$ "1001". In this manner, when the result of addition has become a code which is not used as the note code $NC_4$–$NC_1$ or a code "1100", a value "1" is added to the result of addition for correction of the value of the result of addition.

A carry signal generated by the adder 14-4 when the result of addition has exceeded "1111" is applied to the adder 12-5 through the AND gate $A_{91}$ which has been enabled by the output "1" of the above described AND gate $A_{85}$.

The signal $SD_5$ among the subordinate note forming data $SD_1$–$SD_5$ is applied to the inputs A of the adders 12-5 and 12-6 through a NOR gate $NR_7$ and an OR gate $OR_{73}$. If the signal $SD_5$ which represents a note interval of one octave is "1", the octave data $B_1$–$B_3$ produced by the dealy flip-flops $DF_{44}$ through $DF_{46}$ is raised by one octave. If the signal $SD_5$ is "0", signals "1" and 37 0" are applied to the inputs A of the adders 12-5 and 12-6 in response to the octave code $OC_1$, $OC_2$ from the key code registers 9-5 and 9-6 and the delay flip-flops $DF_{44}$ through $DF_{46}$ produce the octave data $B_1$–$B_3$ representing the first octave. If the signal $SD_5$ is turned to "1" in this state, signals "0" and "1" are respectively applied to the inputs A of the adders 12-5 and 12-6 and the delay flip-flops $DF_{44}$ through $DF_{46}$ produce the octave data $B_1$–$B_3$ representing the second octave which is one octave higher than the first octave.

If a predetermined chord has been formed by notes of keys depressed in the lower keyboard and this chord thereafter is broken by change in the depressed keys, the root note of the broken chord is used again. When a predetermined chord has been formed by the notes of the keys depressed in the lower keyboard, the AND gate $A_{37}$ (FIG. 8) of the control signal forming circuit 11 is enabled to provide a signal "1" to the memory 39 thorugh the OR gate $OR_{39}$ 39. The memory 39 thus stores a signal "1".

If keys depressed in the lower keyboard have been changed and the chord has been broken, the output NCH of the memory 36 (FIG. 9) is turned to "1" and this signal "1" is applied to an AND gate $A_{32}$ of the control signal forming circuit 11 (FIG. 8). The AND gate $A_{32}$ receives at the other input thereof a signal produced by inverting the output CHH of the chord detection signal memory 37 by an inverter $I_{23}$ and the output of the memory 39. The AND gate $A_{32}$ therefore is enabled and a signal "1" is applied to an AND gate $A_{41}$. The AND gate $A_{41}$ thereby outputs a signal "1" and this signal "1" is applied to a delay flip-flop $DF_{32}$ through OR gates $OR_{41}$ and $OR_{57}$. The output of the delay flip-flop $DF_{32}$ is applied to the AND gate $A_{85}$ (FIG. 11) as the automatic bass chord data selection signal AKD, whereby a subordinate note forming operation is performed in the same manner as was previously described.

An AND gate $A_{40}$ is enabled during the last 48 microseconds of the signal $A_1$T and a signal "1" is applied to the AND gate $A_{76}$ of the memory 39 through the NOR gate $NR_8$ thereby clearing the signal stored in the memory 39. To the AND gate $A_{76}$ of the memory 39 are also applied, through the NOR gate $NR_2$ and line 36, the outputs of AND gates $A_{63}$, $A_{64}$ and $A_{65}$ which are enabled upon receipt of the output signals of the respective AND gates $A_{62}$ of the function data memories 6-1 through 6-3 (FIG. 10) and signal produced by inverting the outputs of the delay flip-flops $DF_{25}$ by inverters $I_{34}$, $I_{35}$ and $I_{36}$. Accordingly, the memory 39 is cleared by turnign on of either the function switch selecting the single finger function, the one selecting the finger chord function or the one selecting the custom function.

If the function switch selecting the memory function is turned on and the signal M thereby is stored in the function data memory 6-4 (FIG. 10), this signal is applied to an AND gate $A_{66}$. The AND gate $A_{66}$ receives at the other inputs thereof the output of the NOR gate $NR_2$ and the output of an OR gate $OR_{52}$ to which are applied the signal CON from the function data memory 6-5 indicating that the constant function has been selected and the signal RHY from the shift register 54

(FIG. 12) indicating that the rhythm is on. The AND gate $A_{66}$ therefore is enabled and produces a memory signal MM if the constant function has been selected or the rhythm is on. The signal MM is applied to the signal hold AND gate $A_{75}$ of the memory 38 (FIG. 8). The root note load signal LKM is also applied to a delay flip-flop $DF_{34}$ of the memory 38 through an OR gate $OR_{59}$. Accordingly, the memory 38 stores a signal "1" if the root note load signal LKN is produced when the memory signal MM is present.

The output M' of the memory 38 is applied to an AND gate $A_{42}$. The AND gate $A_{42}$ receives at the other input thereof a signal produced by inverting the output NCH of the non-chord signal memory 36 by an inverter $I_{22}$. Conditions for enabling the AND gate $A_{42}$ are expressed by the following logical formula (8):

$$FC.M'.A_1T.TTP.\overline{NCH} \quad (8)$$

Accordingly, the AND gate $A_{42}$ is enabled after release of the depressed key and supplies a signal "1" to the delay flip-flop $DF_{32}$ through the OR gates $OR_{41}$ and $OR_{57}$ for producing the automatic bass chord data selection signal AKD. Consequently, by turning on of the function switch selecting the memory function, the automatic bass chord key code data is generated even after the release of the depressed key in accordance with the root note detected on the basis of the note of the depressed key.

In the event that the key depressed in the lower keyboard has been released or a different key has newly been depressed with resulting change in the root note, generation of the subordinate note forming data $_1$–$SD_5$ is inhibited in the following manner. Signals applied to the data inputs of delay flip-flops $DF_{37}$ of the key code registers 9-1 through 9-4 (FIG. 11) and output signals of the delay flip-flops $DF_{37}$ are applied to exclusive OR gates $ER_1$ through $ER_4$. The outputs of the exclusive OR gates $ER_1$ through $ER_4$ in turn are applied to the OR gate $OR_{76}$ (FIG. 12) through the OR gate $OR_{63}$. The output of the OR gate $OR_{76}$ is inverted by the inverter $I_{47}$ and thereafter is applied to the AND gate $A_{122}$. Accordingly, change in the signal applied to the delay flip-flops $DF_{37}$ of the key code registers 9-1 through 9-4 causes an output "1" to be produced by any one of the exclusive OR gates $ER_1$ through $ER_4$. This disables the AND gate $A_{122}$ and, accodingly, generation of the subordinate note data $SD_1$–$SD_5$ is inhibited.

An OR gate $OR_{63}$ also receives the signal CON selecting the constant function stored in the function data memory 6-5 (FIG. 10) and a signal produced by inverting the automatic base chord data selection signal AKD by an inverter $I_{42}$. Accordingly, generation of the subordinate note forming data $SD_1$–$SD_5$ is likewise inhibited when the constant function has been selected or the automatic bass chord data selection signal AKD has not been produced.

GENERATION OF THE KEY CODE DATA IN CASE THE CUSTOM FUNCTION HAS BEEN SELECTED

If the custom function has been selected, the automatic chord performance is made in accordance with notes of plural keys depressed in the lower keyboard and the automatic bass chord performance is made in accordance with a note of a single key depressed in the pedal keyboard. More specifically, the key code data for performing the automatic chord is generated in accordance with signals from the key switches being actually depressed in the lower keyboard in the same manner as in the case where the finger chord has been selected. On the other hand, the key code data for performing the automatic bass is generated in the following manner in accordance with a type of chord formed by the notes of the plural keys depressed in the lower keyboard and utilizing the note of the single key depressed in the pedal keyboard as a root note.

As the block P including the key switch of the pedal keyboard has been extracted by the block detection circuit 2 (FIG. 4) and the signal PT has been outputted from the AND gate $A_{26}$ of the decoder 10 (FIG. 8), this signal is applied as the root note load signal LKN to the key code registers 9-1 through 9-4 through the AND gate $A_{35}$ and the OR gate $OR_{38}$ causing the note code signal $NC_1$–$NC_4$ representing the note of the key depressed in the pedal keyboard to be loaded in delay flip-flops $DF_{37}$ of the key code registers 9-1 through 9-4.

In the meanwhile, if the notes of the keys being depressed in the lower keyboard have formed a chord, the sinals $D_7$, $D_m$ and $D_d$ are generated in accordance with a type of the chord detected by the chord detection circuit 5 (FIG. 9). The signals $D_7$, $D_m$ and $D_d$ are stored in corresponding chord memories 55-1 through 55-3 of the subordinate note forming data generation circuit 13 (FIG. 12).

The subordinate note forming data $SD_1$–$SD_5$ is produced by the subordinate note forming data generation circuit 13 (FIG. 13) in accordance with the signals $D_7$, $D_m$ and $D_d$ representing the type of the chord stored in the chord memories 55-1 through 55-3 and the bass pattern signal $T_1$, $T_2$, $T_4$, $T_8$ outputted by the shift register 54. The subordinate note forming data $SD_1$–$SD_5$ is applied to the adders 12-1 through 12-6 (FIG. 11) to form desired subordinate note signals in accordance with the root note loaded in the key code registers 9-1 through 9-4. This operation is the same as in the case where the finger chord function has been selected.

If the memory function has been selected and the memory signal MM is being provided by the AND gate $A_{66}$ (FIG. 10), the key code data KC is generated with a note of a key which was depressed in the pedal keyboard being utilized as a root note even after the depressed key has been released. If a key is depressed in the pedal keyboard, the AND gate $A_{35}$ (FIG. 8) is enabled and the note code $NC_4$–$NC_1$ representing the note of the depressed key is loaded in the delay flip-flops $DF_{37}$ of the key code registers 9-1 through 9-4. The output "1" of the AND gate $A_{35}$ is also applied to the memory 39 and stored therein through the OR gate $OR_{39}$. If the memory signal MM is present at this time, the AND gate $A_{35}$ is enabled to cause the root note load signal LKN to be outputted from the OR gate $OR_{38}$ and a signal "1" to be stored in the memory 38.

During the last 48 microseconds of the signal $A_1T$ the AND gate $A_{39}$ is enabled and a signal "1" is inverted by a NOR gate $NR_8$ and thereafter is applied to the AND gate $A_{76}$ of the memory 39 to clear the storage of the memory 39. Accordingly, if the key depressed in the pedal keyboard is released, the output of the memory 39 is turned to "0". This signal is inverted by the inverter $I_{21}$ and thereafter is applied to an AND gate $A_{43}$. The AND gate $A_{43}$ receives at the other inputs thereof the output signal M' of the memory 38, the signal TTP, the signal CA and the signal $A_1T$. Conditions for enabling the AND gate $A_{43}$ are expressed by the following logical formula (9):

$$Ca.M'.A_1T.TTP.\overline{Q}' \quad (9)$$

In the above formula (9), $\overline{Q}'$ designates a signal produced by inverting the output of the memory 39.

Accordingly, the AND gate $A_{43}$ is enabled to apply a signal "1" to a delay flip-flop $DF_{32}$ through the DR gates $OR_{41}$ and $OR_{57}$. The delay flip-flop $DF_{32}$ thereupon produces the automatic bass chord data selection signal AKD and the subordinate note forming operation is performed in the same manner as has previously been described with the note of the key which was being depressed in the pedal keyboard before the release of the key being utilized as a root note.

GENERATION OF THE KEY CODE DATA IN CASE THE SINGLE FINGER FUNCTION HAS BEEN SELECTED

If the single finger function has been slected, the key code data representing chord notes for performing the automatic chord and the key code data representing the chord notes for performing the automatic bass are produced in accordance with a note of a single key depressed in the lower keyboard.

Since the key depressed in the plower keyboard is only one in the automatic bass chord performance according to the single finger function, a type of chord cannot be detected. Accordingly, an arrangement is made so that a type of chord can be indicated by depressing a white key or a block key in the pedal keyboard. More specifically, depression of a white key in the pedal keyboard designates a chord including a minor seventh degree note 7 (i.e. seventh chord), whereas depression of a block key designates a chord including a minor third degree note 3 (i.e. minor chord). If neither a white key nor a black key is depressed, that designates a major chord.

If a white key or a black key is depressed in the pedal keyboard, the signal PT is produced by the AND gate $A_{26}$ of the decoder 10 (FIG. 8). This signal PT is applied to an AND gate $A_{33}$. The AND gate $A_{33}$ receives at the other input thereof the signal SF indicating that the single finger function has been selected. The AND gate $A_{33}$ therefore is enabled to apply a signal PT.SF to AND gates $A_{56}$ and $A_{57}$ of the chord detection circuit 5 (FIG. 9). To the other input of the AND gate $A_{56}$ are applied thorugh an OR gate $OR_{46}$ signals on the lines 21, 23, 25, 26, 28, 30, 32 and 33 of the note detection circuit 4 corresponding to the key switches of the white keys. To the other input of the AND gate $A_{57}$ are applied through an OR gate $OR_{47}$ signals on the output lines 22, 24, 27, 29, 31 corresponding to the key switches of the black keys. If, accordingly, a white key is depressed in the pedal keyboard, the AND gate $A_{56}$ is enabled and a signal "1" is outputted as the seventh detection signal $D_7$ through the OR gate $OR_{46}$. If a black key is depressed in the pedal keyboard, the AND gate $A_{57}$ is enabled and a signal "1" is outputted as the minor detection signal $D_m$ through the OR gate $OR_{49}$.

The seventh detectection signal $D_7$ and the minor detection signal $D_m$ are applied to the chord memories 55-1 and 55-2 shown in FIG. 12 and stored therein.

If neither white key nor a black key is depressed in the pedal keyboard, the AND gates $A_{56}$ and $A_{57}$ are not enabled so that no signal is stored in the chord memories 55-1 and 55-2. This state represents that the major chord has been designated.

As the non-chord signal NC is outputted from the chord detection circuit 5 (FIG. 9), the AND gate $A_{38}$ is enabled and the root note load signal LKN is outputted from the OR gate $OR_{38}$, thereby causing the note code $NC_1$–$NC_4$ representing a note of a single key being depressed in the lower keyboard to be loaded as a signal representing a root note in the delay flip-flop $DF_{37}$ of the key code registers 9-1 through 9-4 (FIG. 11).

The automatic bass performance key code data in the case where the single finger function has been selected is produced by applying the output signals of the chord memories 55-1 and 55-2 and the subordinate note forming data $SD_1$–$SD_5$ generated in response to the bass pattern signal $T_1$, $T_2$, $T_4$, $T_8$ from the shift register 54 to the adders 12-1 through 12-5 (FIG. 11) and thereby processing the note code $NC_1$–$NC_4$ representing the root note stored in the key code registers 9-1 through 9-4. The operations of the subordinate note forming data generation circuit 13 and the adders 12-1 through 12-6 are the same as those in the case where the finger chord function or the custom function has been selected. In the case of the single finger function, however, the signal Dd representing the diminishment chord is not used.

In the case where the single finger function has been selected, only one key is depressed in the lower keyboard and, accordingly, key code data for the automatic chord performance cannot be produced on the basis of the signal from the key switch for the single depressed key. Accordingly, the key code data for the automatic bass chord performance in the case of the single finger function mode is generated by processing a root note by the subordinate note forming data $SD_1$–$SD_4$ generated by the subordinate note data forming generation circuit 13 (FIG. 12).

The signal SF from the function data memory 6-1 (FIG. 10) indicating that the single finger function has been selected is applied to an AND gate $A_{96}$ shown in FIG. 12. The AND gate $A_{96}$ receives at the other input thereof the automatic bass chord data selection signal AKD which is the output signal of the delay flip-flop $DF_{32}$ (FIG. 8). The AND gate $A_{96}$ therefore is enabled upon receipt of the automatic bass chord data selection signal AKD and applies a signal "1" to a shift register 58. The shift register 58 successively shifts a signal "1" and output a signal "1" from the outputs $Q_A$ through $Q_c$.

The subordinate note forming data $SD_1$–$SD_5$ used for forming the key code data for the automatic chord performance is generated in response to the output of the shift register 58 and the signals stored in the chord memories 55-1 and 55-2.

Assume, for example, that a signal "1" is stored in the chord memory 55-1 thereby designating the seventh dh chord. If in this case a signal "1" is delivered from the output $Q_A$ of the shift register 58, the subordinate note forming data $SD_4$–$SD_1$ "0000" is generated. If a signal "1" is delivered from the output $Q_B$ of the shift register 58, an AND gate $A_{99}$ is enabled and the subordinate note forming data $SD_4$–$SD_1$ "0101" representing the major third degree note interval is generated. If a signal "1" is delivered from the output $Q_c$ of the shift register 58, an AND gate $A_{98}$ is enabled and the subordinate note forming data $SD_4$–$SD_1$ "1101" representing the minor seventh degree note interval is generated.

Relations between the output signals $Q_A$, $Q_B$ and and $Q_C$ of the shift register 58 and the subordinate note forming data $SD_1$–$SD_4$ generated in response to these output signals in cases where a signal "1" is not stored in the chord memory 55-1 or 55-2 whereby the major chord is designated, where a signal "1" is stored in the chordd memory 55-2 whereby the major chord is designated and where a signal "1" is stored in the chord memry 55-1 whereby the seventh chord is designated are shown in the following Tables 13, 14 and 15:

TABLE 13

| | In case the major chord has been designated | | | |
|---|---|---|---|---|
| | $SD_4$ | $SD_3$ | $SD_2$ | $SD_1$ |
| $Q_A$ | 0 | 0 | 0 | 0 |
| $Q_B$ | 0 | 1 | 0 | 1 |
| $Q_C$ | 1 | 0 | 0 | 1 |

TABLE 14

| | In case the minor chord has been designated | | | |
|---|---|---|---|---|
| | $SD_4$ | $SD_3$ | $SD_2$ | $SD_1$ |
| $Q_A$ | 0 | 0 | 0 | 0 |
| $Q_B$ | 0 | 1 | 0 | 0 |
| $Q_C$ | 1 | 0 | 0 | 1 |

TABLE 15

| | In case the seventh chord has been designated | | | |
|---|---|---|---|---|
| | $SD_4$ | $SD_3$ | $SD_2$ | $SD_1$ |
| $Q_A$ | 0 | 0 | 0 | 0 |
| $Q_B$ | 0 | 1 | 0 | 1 |
| $Q_C$ | 1 | 1 | 0 | 1 |

If the signal "1" is produced from the outputs $Q_A$ through $Q_C$ of the shift register 58, an OR gate $OR_{77}$ produces a signal $T_{CH}$. This signal $T_{CH}$ is applied to the AND gates $A_{81}$ through $A_{84}$ through the OR gate $OR_{64}$. The AND gates $A_{81}$ through $A_{84}$ are thereby enabled to apply the note code $NC_1$–$NC_4$ representing the root note and stored in the key code registers 9-1 through 9-4 to the inputs A of the adders 12-1 through 12-4.

To the inputs B of the adders 12-1 through 12-4 are applied the subordinate note forming data $SD_1$–$SD_4$. By adding the note code $NC_1$–$NC_4$ representing the root note and the subordinate notefforming data $SD_1$–$SD_4$ together, note data $N_1$–$N_4$ for the automatic chord erformance is produced. This note data $N_1$–$N_4$ is delivered out through delay flip-flops $DF_{40}$ through $DF_{43}$. The operation for forming of the note data $N_1$–$N_4$ is substantially the same as the one for forming the automatic bass performance key code data.

The signal $T_{CH}$ produced by the OR gate $OR_{77}$ is applied to an OR gate $OR_{28}$ (FIG. 8) to produce the signal L representing a chord note (a note in the lower keyboard). This signal $T_{CH}$ is also supplied to the inputs A of the adders 12-5 and 12-6 through the NOR gate $NR_7$ and the OR gate $OR_{73}$ shown in FIG. 11. The output of the adder 12-5 thereupon is turned to "0" and the output of the adder 12-6 is turned to "1" whereby the octave data $B_1$–$B_3$ representing the second octave is provided by the delay flip-flops $DF_{44}$ through $DF_{46}$.

If the memory function has been selected, the key code data KC representing the chord tones for the automatic chord performance and the key code data KC representing the bass tone for the automatic bass performance are generated using the note of the depressed key in the lower keyboard as a root note even after the depressed key has been released. If the function siwtch for selecting the memory function has been turned on, the memory signal MM outputted from the AND gate $A_{66}$ (FIG. 10) is applied to the AND gate $A_{75}$ of the memory 38 (FIG. 8). Accordingly, a signal "1" is stored in the memory 38 simultaneously with outputting of the root note load signal LKN from the OR gate $OR_{38}$. The output M' of the memory 38 is applied to an AND gate $A_{44}$. The AND gate $A_{44}$ receives at the other inputs thereof a signal $\overline{NCH}$ produced by inverting the output NCH of the non-chord memory 36 by the inverter $I_{22}$, the signal TTP, the signal SF and the signal $A_1T$. Conditions for enabling the AND gate $A_{44}$ are expressed by the following logical formula (9):

$$\overline{NCH}.M'.TTP.SF.A_1T \qquad (9)$$

Accordingly, the AND gate $A_{44}$ is enabled after release of the key depressed in the lower keyboard to apply a signal "1" to the delay flip-flop $DF_{32}$ through the OR gates $OR_{41}$ and $OR_{57}$. This causes the delay flip-flop $DF_{32}$ to produce the automatic bass chord data selection signal AKD whereby the key code data representing the chord tones for the automatic chord performance and the key code data representing the chord tones for the automatic chord performance and the key code data representing the bass tones for the autoamtic bass performance are generated using the note of the key being depressed in the lower keyboard before release of the key as the root note.

GENERATION OF A CHORD TONE SOUNDING TIMING SIGNAL ETC.

A chord tone sounding timing signal CG which designates timing of sounding of a chord tone (a tone of the lower keyboard) is generated in response to the signal $T_C$ outputted by the shift register 54 (FIG. 12). The signal $T_C$ outputted by the shift register 54 is applied to an AND gate $A_{117}$. To another input of the AND gate $A_{117}$ is applied the automatic bass chord selection signal ABC which is outputted by the OR gate $OR_{53}$ (FIG. 10). This signal ABC is a signal which becomes "1" when only one of the signal SF for selecting the single finger function, the signal FC for selecting the finger chord function and the signal CA for selecting the custom function has been produced, i.e., when any one of the automatic bass chord functions has been selected. Accordingly, when any one of the automatic bass chord functions has been selected, the AND gate $A_{117}$ is enabled to deliver out the signal $T_C$ as the chord tone sounding timing signal CG.

A normal gate signal NG is employed for adjusting the level of a musical tone depending upon whether the automatic bass chord is performed or the normal performance is made. If a key is depressed in the lower keyboard, or a key is depressed in the pedal keyboard when neither the single finger function, finger chord function nor the custom function has been selected, or a key is depressed in the pedal keyboard when the custom function has been selected, a signal "1" is outputted by the OR gate $OR_{37}$ (FIG. 8) and applied to the memory 370. The memory 370 stores this signal "1" by applying it to the delay flip-flop $DF_{33}$ through the OR gate $OR_{58}$ the output signal of which is fed back to the input thereof through the AND gate $A_{74}$ and the OR gate $OR_{58}$.

The output of the memory 370 is applied to an AND gate $A_{119}$ (FIG. 12) as the key-on signal KON. The AND gate $A_{119}$ receives at other inputs thereof the output of an AND gate $A_{116}$ which is enabled when the bass pattern signal $T_8$, $T_4$, $T_2$, $T_1$ delivered from the shift register 54 is "1111" (indicating that no rhythm has been selected), the constant signal CON and a signal produced by inverting the signal ABC by an inverter $I_{48}$ through an OR gate $OR_{90}$.

Accordingly, the AND gate $A_{119}$ is enabled when any one of the output of the AND gate $A_{116}$, the constant signal CON and the output of the inverter $I_{48}$ is "1" and a signal "1" is applied to a delay flip-flop $DF_{50}$ through an OR gate $OR_{91}$. The output signal of the delay flip-flop $DF_{50}$ is fed back to the input thereof through an AND gate $A_{118}$ and the OR gate $OR_{91}$. The AND gate $A_{118}$ receives at another input thereof the outputs of the OR gate $OR_{90}$. By this arrangement, the signal applied to the delay flip-flop $DF_{50}$ is held therein so long as the output of the OR gate $OR_{90}$ is "1". The output NG of the delay flip-flop $DF_{50}$ is inverted by an inverter $I_{59}$ and thereafter is delivered from a terminal $T_{\overline{NG}}$ as a signal $\overline{NG}$.

To the AND gate $A_{74}$ of the memory 370 (FIG. 8) outputting the key-on signal KON is applied a signal produced by inverting the output signal $LF_1$ of the delay flip-flop $DF_{30}$ by an inverter $I_{62}$ so that the signal stored in the memory 370 is cleared each time the signal $LF_1$ is produced.

If a signal $T_0$ is produced by the shift register 54 when the constant signal CON is present, an AND gate 115 is enabled and the subordinate note forming data $SD_5$ is thereby turned to "1" resulting in rise of the key code data KC by one octave. If the signal $T_0$ is produced when the bass pattern signal $T_8$ is "1", an AND gate $A_{114}$ is enabled. In this case also the subordinate note forming data $SD_5$ is turned to "1" and the key code data KC is raised by one octave.

The constant signal CON and the output of the AND gate $A_{116}$ are delivered as a signal CON' through an OR gate $OR_{89}$. This signal CON' is used for continuously producing the chord tone instead of producing it intermittently at a timing of the chord tone sounding timing signal CG.

What is claimed is:

1. A key code data generator comprising:

a switch matrix circuit including a plurality of key switches assigned to respective notes and connected between row lines and column lines, said row lines defining respective blocks of the key switches and said column lines defining respective notes of the key switches in each said block;

a block detection circuit connected to said switch matrix circuit for detecting all row lines to which key switches in operation are connected;

a note detection circuit connected to said switch matrix circuit for detecting all column lines connected with a single one of said detected row lines via the key switches in operation, and delivering note codes representing said detected row lines one after another in a time shared fashion, the column line detection being carried out for one row line after another for each of said row lines detected;

a control circuit connected to said block detection circuit and said note detection circuit for causing said row line detection in a first period of time and said column line detection in a second period of time;

a circuit connection for causing said note detection circuit to deliver in a third period of time all the note codes available one after another;

a chord detection circuit including a shift register connected to said note detection circuit and having stages for storing the state of said column lines detected with respect to predetermined row lines in said second period, contents of said stages being circulatingly shifted in synchronism with said time shared delivery of the note codes from said note detection circuit in said third period, and a chord type detecting logic connected to said stages for detecting establishment of one of predetermined types of chord; and a code register for storing the note code delivered from said note detection circuit at the moment said chord type detecting logic detects said establishment, the registered note code representing the root note of the detected chord.

2. A key code data generator as defined in claim 1 wherein said circuit connection further causes said note detection circuit to deliver in a fourth period of time all the note codes available one after another;

the contents of said stages of said chord detection circuit are circulatingly shifted in synchronism with the time shared delivery of said note codes in said fourth period;

said chord detection circuit further comprises a preferential detection network connected to a predetermined one of said stages for detecting only if said chord type detecting logic has not detected any establishment of a chord, a first arrival of the shifted contents at said predetermined one stage in said fourth period; and said code register stores the note code delivered from said note detection circuit at the moment said preferential detection network detects said arrival, the registered note code representing a note to be used as a root note for performing a chord.

3. A key code data generator as defined in claim 2 which further comprises:

a data generation circuit connected to said chord detection circuit for generating, upon detection of said establishment of a type of chord, data for forming subordinate notes which are appropriate for the detected type of chord; and a processing circuit connected to said code register and to said data generation circuit for processing said registered note code and said data and producing key codes which designate a root note and subordinate notes for a chord to be performed as an automatic bass chord performance.

4. A key code data generator as defined in claim 1 wherein:

said switch matrix circuit further includes at least one further row lines in addition to said row lines which are connected with said key switches, and a plurality of function switches assigned to respective performance functions to be selectively rendered and connected between said at least one further row lines and said column lines, said at least one further row lines defining blocks of the function switches and being connected to said block detection circuit;

said block detection circuit and said note detection circuit further detect function switches in operation;

and said key code data generator further comprising:

a function data memory connected to said note detection circuit for storing the detected states of said function switches while the blocks including the function switches are being detected, and for delivering corresponding function data; and enabling means, connected to said function data memory, for enabling said circuit connection, said chord detection circuit and said code register to operate in the designated function in response to delivery of certain function data.

5. A key code data generator as defined in claim 1 wherein:

said note detection circuit includes a plurality of storage cells each corresponding to a respective note name in a musical scale, data representing detected column lines connected via key switches in operation being entered into storage cells corresponding to the note names of said operated key switches during said first period of time, a note encoder connected to said cells, said note encoder sequentially producing, during said second period of time, the note codes for data entered in said storage cells, said control circuit causing entry of data into all of said storage cells at the beginning of said third period of time, and causing sequential readout of said cells during said third period of time in synchronism with said circulating shifting of said chord detection circuit, said note encoder thereby producing all of the note codes one after another.

6. A key code data generator as defined in claim 4 and contained in a single integrated circuit chip, said certain function data being used to control operations of other circuits on said chip, together with function data transmission means for providing other delivered function data in serial format to an output terminal of said chip for use by circuitry external to said chip.

7. In combination with an electronic musical instrument having a note selection keyboard and switches for the selection of performance functions, a key code data generator comprising:

a note detection circuit operatively connected to said keyboard and to said switches and having a set of storage cells, individual storage cells being assigned both to a respective note name in a musical octave and to a specified performance function, and an encoder directly connected to said set of storage cells for providing note codes identifying the cells containing data, a chord detection register having a separate stage corresponding to each note name, and associated chord detection logic for detecting chord types by the relative position of data in said stages, and control signal formation means for providing sequential first, second and third sets of control signals which operate said note detection circuit sequentially in:

a first mode in which said first set of control signals causes data indicative of selected function switches to be entered into ones of said storage cells assigned to the corresponding functions, said encoder then providing note codes representing said selected performance functions, a second mode in which said second set of control signals causes data representing keys selected on said keyboard to be entered into storage cells assigned to note names corresponding to the selected keys, said encoder then providing note codes representing selected notes, said selected key representing data also being entered into corresponding stages in said chord detection register in the event that, during said first mode, the note code for a certain selected performance function was provided, and a third mode, enabled by provision during said first mode of said note code for a certain selected function, wherein said third set of control signals causes said chord detection register to be recirculatingly shifted in synchronism with successive provision by said encoder of note codes for each of said storage cells, detection of a chord by said detection logic causing said control signal formation means to generate a signal which gates the note code concurrently provided by said encoder to a key code register, said gated note code identifying the root note of said chord.

8. On a single integrated circuit chip intended for use in an electronic musical instrument of the type having note selection keys and performance function selection switches, said keys and said switches being arranged in blocks connected to said chip by common block lines:

first circuit means for scanning each block of performance function switches to detect operated switches and to produce corresponding performance function designating codes for control of circuitry on said chip, and first output means for externally delivering said performance designation codes only to said instrument via an output terminal on said chip, chord detection circuitry on said chip, a second circuit means for scanning each block of keys to detect depressed keys and, in response to production by said first circuit means of certain codes designating specific automatic performance functions, to supply data representing detected depressed keys to said chord detection circuitry a second output means for supplying to said instrument, via a separate output port on said chip, multibit note codes representing detected depressed keys detected by said second circuit means, and third circuit means, enabled by production by said first circuit means of said certain automatic performance function designating codes and including said chord detection circuitry, for detecting the chord type and root note represented by said depressed keys, and for supplying via said output port note codes, based on the detected chord type and root note, for an automatic performance of the type designated by said certain function designating codes.

* * * * *